US011548601B2

(12) United States Patent
Hugh

(10) Patent No.: US 11,548,601 B2
(45) Date of Patent: Jan. 10, 2023

(54) MULTI-CHAMBER INFLATABLE DEVICE

(71) Applicant: Christopher Ian Roxburgh Hugh, Torrance, CA (US)

(72) Inventor: Christopher Ian Roxburgh Hugh, Torrance, CA (US)

(73) Assignee: Crusoe Survival, LLC, Torrance, CA (US)

( * ) Notice: Subject to any disclaimer, the term of this patent is extended or adjusted under 35 U.S.C. 154(b) by 0 days.

(21) Appl. No.: 17/086,090

(22) Filed: Oct. 30, 2020

(65) Prior Publication Data

US 2021/0129957 A1 May 6, 2021

Related U.S. Application Data

(60) Provisional application No. 62/930,511, filed on Nov. 4, 2019.

(51) Int. Cl.
*B63C 9/04* (2006.01)
*B63C 9/00* (2006.01)
*B60C 29/00* (2006.01)

(52) U.S. Cl.
CPC ..... *B63C 9/24* (2013.01); *B63C 9/04* (2013.01); *B63C 2009/042* (2013.01)

(58) Field of Classification Search
CPC .... B63C 9/00; B63C 9/04; B63C 9/24; B63C 2009/042; B63H 9/00; B63H 9/06; B63H 9/069; B64D 17/00; B64D 17/02; B64D 17/025
USPC ..... 441/41
See application file for complete search history.

(56) References Cited

U.S. PATENT DOCUMENTS

| | | | |
|---|---|---|---|
| 1,203,631 | A | 11/1916 | Kreid |
| 1,410,438 | A | 3/1922 | Willows et al. |
| 1,434,402 | A | 11/1922 | Myers |
| 1,570,470 | A | 1/1926 | Fritsche et al. |
| 2,114,301 | A | 4/1938 | Harrigan |

(Continued)

FOREIGN PATENT DOCUMENTS

| | | | |
|---|---|---|---|
| AU | 2015278253 | 1/2017 | |
| GB | 2562756 | 11/2018 | |
| WO | WO-2019179924 A1 * | 9/2019 | ..... B63H 9/069 |

OTHER PUBLICATIONS

Halkey-Roberts Customer Drawings for Short Boat Valve Assy. dated Jul. 17, 2012; 1 page.

*Primary Examiner* — Lars A Olson
(74) *Attorney, Agent, or Firm* — Knobbe Martens Olson and Bear, LLP

(57) ABSTRACT

A flotation device that can include a multi-chamber flotation element having an active inflation chamber and a passive inflation chamber. The flotation device can have a first valve in fluid communication with the active inflation chamber but not the passive inflation chamber and an opening in fluid communication with the passive inflation chamber but not the active air chamber. The active inflation chamber can be configured to be inflated through the first valve. The active inflation chamber can be configured to expand the passive inflation chamber from a collapsed state to an expanded state as the active inflation chamber is expanded by, for example and without limitation, permitting ambient air to enter the passive inflation chamber when a pressure within the passive inflation chamber is less than an ambient air pressure.

38 Claims, 22 Drawing Sheets

(56) References Cited

U.S. PATENT DOCUMENTS

| | | | |
|---|---|---|---|
| 2,173,567 | A | 9/1939 | Shafer |
| 2,223,625 | A | 12/1940 | Krupp |
| 2,334,072 | A | 11/1943 | Cooper |
| 2,399,494 | A | 4/1946 | Manson et al. |
| 2,407,666 | A | 9/1946 | Kearny |
| 2,421,679 | A | 6/1947 | Bingham, Jr. |
| 2,752,616 | A | 7/1956 | Coates et al. |
| 2,800,666 | A | 7/1957 | Allenbach |
| 2,914,779 | A | 12/1959 | Walker |
| 2,933,739 | A | 4/1960 | Miller et al. |
| 3,058,127 | A | 10/1962 | Hassold |
| 3,080,582 | A | 3/1963 | Reffell |
| 3,092,854 | A | 6/1963 | Manhart |
| 3,131,406 | A | 5/1964 | Cousteau et al. |
| 3,155,992 | A | 11/1964 | Shewmake et al. |
| 3,176,935 | A | 4/1965 | White et al. |
| 3,212,111 | A | 10/1965 | Reffell |
| 3,359,579 | A | 12/1967 | Reffell et al. |
| 3,517,401 | A | 6/1970 | Lee |
| 3,574,244 | A | 4/1971 | Huss |
| 3,768,467 | A | 10/1973 | Jennings |
| 3,768,761 | A | 10/1973 | Cramer |
| 3,781,933 | A | 1/1974 | Soter |
| 3,813,717 | A | 6/1974 | Mousetis |
| 3,995,339 | A | 12/1976 | Kaufman |
| 4,058,862 | A | 11/1977 | Stevens et al. |
| 4,187,570 | A | 2/1980 | De Simone |
| 4,342,278 | A | 8/1982 | Horan |
| 4,394,124 | A | 7/1983 | Cooper |
| 4,731,037 | A | 3/1988 | Rhodes |
| 4,747,797 | A | 5/1988 | Hindle |
| 4,750,447 | A | 6/1988 | Spinosa et al. |
| 4,907,997 | A | 3/1990 | Hall |
| 4,942,839 | A | 7/1990 | Chuan |
| 5,170,738 | A | 12/1992 | Patten |
| 5,219,307 | A | 6/1993 | Morrison |
| 5,284,453 | A | 2/1994 | Kun |
| 5,297,978 | A | 3/1994 | Ramsey |
| 5,421,757 | A | 6/1995 | Basiliere |
| 5,437,569 | A | 8/1995 | Ming |
| 5,738,557 | A | 4/1998 | Biesecker |
| 5,888,111 | A | 3/1999 | Walker |
| 5,987,661 | A | 11/1999 | Peterson |
| 6,004,177 | A | 12/1999 | Biesecker et al. |
| 6,164,237 | A | 12/2000 | Coryell et al. |
| 6,168,487 | B1 | 1/2001 | Nissen |
| 6,574,804 | B1 | 6/2003 | Boujon |
| 7,335,078 | B2 | 2/2008 | Kent |
| 7,666,046 | B2 | 2/2010 | Larochelle |
| 7,704,112 | B2 | 4/2010 | Kim |
| 7,896,719 | B2 | 3/2011 | Rayles et al. |
| 7,918,698 | B2 | 4/2011 | Schloegel |
| 8,070,543 | B1 | 12/2011 | Faletra |
| 8,414,340 | B1 | 4/2013 | Vu |
| 8,522,708 | B2 | 9/2013 | Chon |
| 8,668,539 | B2 | 3/2014 | Chun et al. |
| 8,851,949 | B2 * | 10/2014 | Grutta ..... A62B 33/00 441/80 |
| 8,876,568 | B2 * | 11/2014 | Blenkarn ..... B63C 9/081 441/80 |
| 8,920,205 | B2 | 12/2014 | McCarthy |
| 9,205,900 | B2 | 12/2015 | Tatum |
| 9,289,633 | B2 * | 3/2016 | Walker ..... B63C 9/18 |
| 10,286,986 | B2 | 5/2019 | Hugh |
| 2002/0049017 | A1 | 4/2002 | Ross |
| 2007/0169680 | A1 | 7/2007 | Kim |
| 2012/0227658 | A1 | 9/2012 | Chon |
| 2013/0203310 | A1 | 8/2013 | Newman |
| 2014/0256199 | A1 | 9/2014 | Tatum |

* cited by examiner

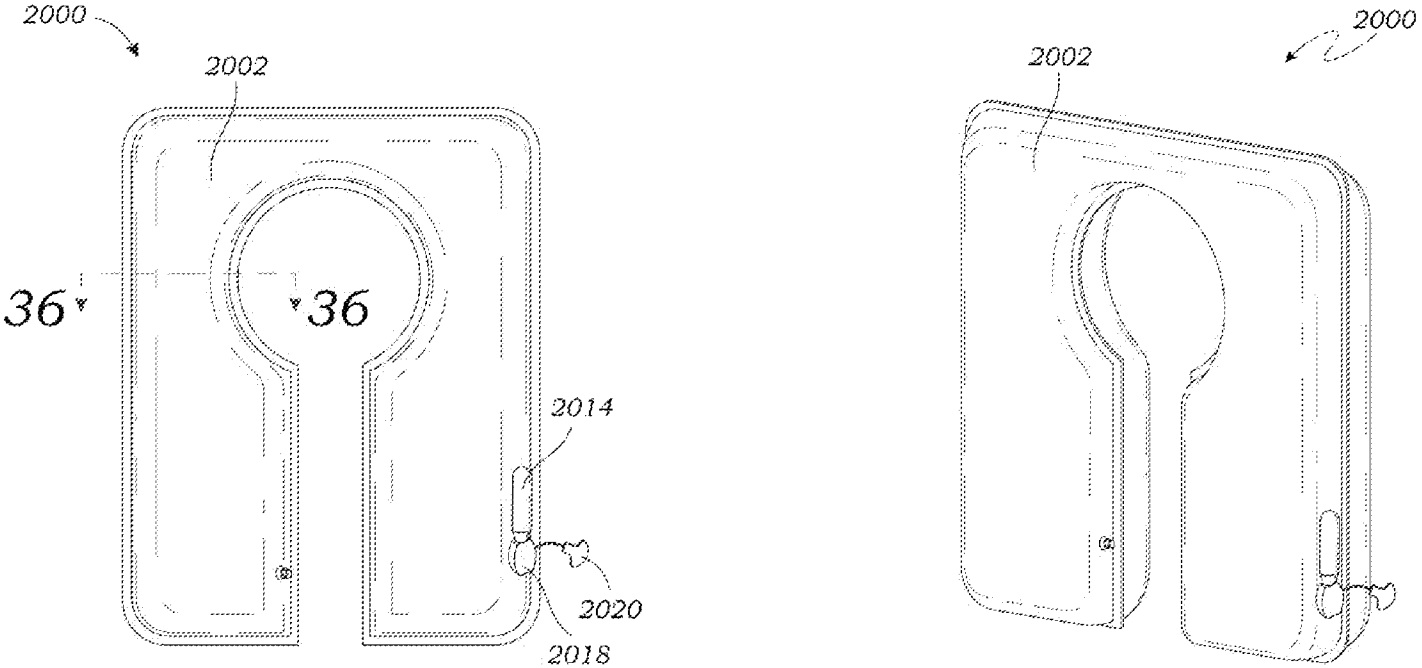
Fig. 35
Fig. 37
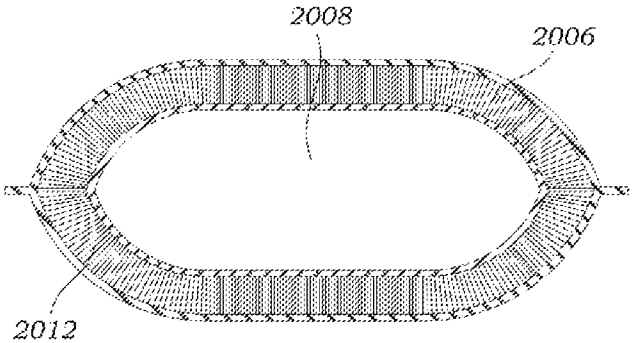
Fig. 36

MULTI-CHAMBER INFLATABLE DEVICE

PRIORITY CLAIM AND INCORPORATION BY REFERENCE

The present application claims priority from U.S. Patent Application No. 62/930,511, filed on Nov. 4, 2019, titled MULTI-CHAMBER INFLATABLE DEVICE, the content of this priority application is hereby incorporated by reference herein in its entirety as if fully set forth herein. The benefit of priority is claimed under the appropriate legal basis including, without limitation, under 35 U.S.C. § 119(e). Any and all applications for which a foreign or domestic priority claim is identified in the Application Data Sheet as filed with the present application are hereby incorporated by reference herein in their entirety and made a part of this specification.

FIELD OF THE PRESENT DISCLOSURE

Some embodiments of this disclosure relate to flotation equipment and more specifically to compact, inflatable flotation devices.

BACKGROUND OF THE DISCLOSURE

Field of the Disclosure

Anytime a vehicle, whether it be a ship or an aircraft, travels over a large body of water, there exists a risk that due to an unfortunate occurrence, such as human error, adverse weather, or mechanical failure, passengers and/or crew may find themselves in the water attempting to survive without the vehicle. This may occur far from shore and last for extended periods of time. In such emergency situations, survival depends, in large part, on an individual's ability to stay at the surface of the water to facilitate breathing until assistance can arrive.

Many times, assistance may take several hours or even days to arrive, which may exceed the length of time the individuals in need of rescue are capable of treading water or otherwise physically remaining at the surface under their own power. This is further compounded by the fact that, in many such situations, passengers and/or crew may have sustained injuries during the occurrence that separated them from their vehicle and water temperature may be hypothermic, which may significantly reduce their stamina and/or ability to exert physical effort to remain on the surface of the water. To address this unfortunate contingency, most vehicles that travel over large bodies of water carry personal flotation devices for each individual aboard the vehicle.

The most common form of the personal flotation device is the life vest. A life vest is a positively buoyant device that fits an individual like a vest when properly worn and increases the individual's overall buoyancy such that, at a minimum, the individual's head remains above water without requiring physical effort. In many situations, a properly worn life vest can greatly increase the amount of time an individual can survive while waiting for assistance to arrive.

However, there are some significant drawbacks to life vests. For example, many life vests are constructed from highly buoyant material. Because buoyancy is a function of density, such highly buoyant material is typically very voluminous, making wearing such life vests highly awkward and cumbersome, creating an impediment to the individual's performance or duties on board the vessel. This, in turn, causes many individuals to forgo wearing a life vest until an emergency situation arises or is immediately foreseeable. This behavior reduces the effectiveness of the life vest because it causes a risk that the individual in need will not be able to locate or properly don the device in time, if an emergency situation materializes rapidly.

This shortcoming has been addressed, in part, by the inflatable life vest. While still inconvenient to wear regularly, inflatable life vests are considerably less awkward and cumbersome to wear, because their buoyancy is derived from an air impermeable bladder that is capable of being inflated when activated, either automatically or manually, but that otherwise remains in a deflated, low-profile position. It is important to note that, generally, when personal protective equipment is not awkward and/or cumbersome, use rates of such equipment tend to rise, and therefore, such equipment is typically more effective at saving lives in practice.

There are additional survival challenges associated with water emergencies that life vests cannot effectively address. Perhaps the most significant challenge is that many of the bodies of water that vehicles regularly cross are of a temperature such that individuals in direct contact with the water would not survive for very long, even if they could manage to keep their heads above water indefinitely. When properly wearing a life vest in the water, an individual's body is almost entirely submerged and in direct contact with the water. Water is very efficient at transferring heat away from an individual's body at a fairly rapid rate. Therefore, prolonged submersion in even mildly cold water can be lethal within a deceptively short period of time.

For example, an average person is only expected to stay conscious for 1-2 hours in water that is between 50 and 60 degrees Fahrenheit. In many water emergency situations, 1-2 hours is far shorter than the amount of time that is required for assistance to arrive, even if the assisting party is aware of the exact location of the individual or individuals in need. In situations where the individual or individuals in need must be located first, rescue times can be considerably longer.

Further, large portions of the earth's ocean are much colder than 50-60 degrees Fahrenheit. This means that if a water related emergency situation arose in those regions, a life vest alone would have little or no ability to increase survivability. There exists a need for an emergency flotation aid that is capable of thermally insulating an individual as well as providing buoyancy.

There have been several attempts to mitigate this thermal limitation to traditional life vests by incorporating some form of thermal insulation. Two examples of such attempted solutions are the float coat and the more extreme survival suit.

A float coat is essentially a thermally insulated jacket that includes an inflatable life vest incorporated within. While a float coat may provide more thermal insulation than the typical life vest, most float coats are primarily designed to thermally insulate an individual from thermal loss caused by air, and therefore, are not designed to be particularly proficient at insulating individuals when submerged in water.

By contrast, survival suits are designed to thermally insulate an individual in water and are very effective at achieving this goal; however, survival suits are also very expensive, bulky, require considerable time get into, and because of their waterproof nature, typically do not breathe adequately to be worn comfortably, making them an unsatisfactory option for many uses, including prophylactic use. There exists a need for a personal flotation device that can provide buoyancy and thermal insulation without causing excessive personal inconvenience while performing low risk activities.

Another legacy solution to this water safety problem is the life raft. A life raft typically provides flotation for several individuals and provides the added benefit of allowing individuals to climb out of the water, thereby significantly reducing the rate of thermal loss due to water. Life rafts do, however, have their limitations as well. The biggest limitation is their typical size. Most life rafts are too large and bulky to be physically attached to or worn by an individual; therefore, while most vehicles that travel across large bodies of water carry a life raft, in order to realize the safety benefits of a life raft, an individual on an ill-fated vehicle must have the opportunity to locate where the life raft is stored, remove the life raft, and deploy the life raft. Depending on the circumstances of the water emergency, this opportunity may not always be available.

The typical inflatable life raft is designed to accommodate approximately 4 people, while larger models used on passenger ships and ferries may hold up to 50 people. Most private vessels, small planes and helicopters venturing offshore carry a life raft with a capacity equal to or greater than the number of crew onboard. A typical life raft on these crafts are in the 4-8 person capacity range. These life rafts are quite heavy, weighing 50-100 lbs and are quite bulky, which makes them difficult to remove from their stored position and similarly difficult to deploy. A substantial portion of the weight and bulk of these life rafts is due to the large inflation cylinder that is required to inflate such a raft. In a man overboard situation, a rapidly sinking vessel, or the downing of an aircraft over water, there often isn't enough time for victims to wrestle a large, heavy, inflatable life raft out of its stored position and deploy it. This difficulty may leave individuals in direct contact with the water for an extended period of time and prone to hypothermia and/or death.

Most smaller boats and skiffs do not carry life rafts because they are too bulky and too heavy to have onboard. Moreover, one study recorded 28% of fatalities from commercial fishing vessel loss in California, Oregon and Washington between 2000 and 2006 had no raft aboard.

Some pilots carry one man inflatable life rafts in their aircraft, or strap them to their waist. These rafts typically weigh approximately 6-8 lbs. and have an approximate size of 7" diameter by 12" long. The inflation cylinder for such a raft typically accounts for approximately 35-43 percent of the weight of the raft. The weight and bulkiness of these rafts make the wearer less agile, particularly when climbing through the small door of a sinking plane or while having to maneuver underwater. Fear of not being able to egress the vehicle in a water emergency or simply preferring to not endure the inconvenience of the safety equipment during normal, low risk operation of the vehicle causes many pilots, aircrew and mariners to forego use of these life rafts.

Other issues with these one man life rafts include their high cost and the difficulty of boarding them once deployed. Climbing over the edge of a legacy life raft can be difficult, especially for those who may have been injured in the incident that caused the water emergency. If an individual deploys a legacy life raft and cannot climb in, they may perish from hypothermia as if they did not have a life raft.

These adverse factors (bulk, weight, cost and boarding difficulty) make legacy life rafts a less than ideal solution for many people including air crewmen, deck personnel on ships of all sizes, sailors, commercial and recreational fishermen and other mariners whose lives could potentially be saved if there existed a lightweight personal water safety device that provided both buoyancy, ease of ingress, and thermal protection. There exists a need for a life raft that is small, lightweight, less expensive and easier to board than the currently available models.

There exists a need for an inflation device that can inflate a large inflatable safety device with a smaller inflation cylinder and one that is considerably lighter than existing devices and methods of inflation

SUMMARY OF SOME EMBODIMENTS

Disclosed herein are some exemplifying embodiments of compact flotation devices that can be used to provide buoyancy and reduce loss of personal thermal energy.

Some embodiments of the novel flotation element (also referred to herein as an air bladder) or flotation device disclosed herein have two separate chambers that can work together to provide the buoyancy. Each of these chambers in any embodiments disclosed herein can consist of more than one sub-chamber to provide the benefits of multiple chambers, such as redundancy in the case of puncture, etc. A pressurized outer chamber can partially or completely surround, or couple with, a passively filled or passively pressurized inner chamber. In this configuration, inflation of the actively filled chamber (via compressed gas or other inflation means) can cause the actively filled chamber to expand, thereby expanding the passively filled chamber and causing the passively filled chamber to draw in ambient air through an opening, a port or a one-way valve, into the inner chamber. In any embodiments disclosed herein, the passively filled or expanded chamber can be substantially or completely surrounded by, covered by, or encapsulated by the actively filled chamber, or the passively filled chamber can be only partially covered by or adjacent to and coupled with the actively filled chamber. In any embodiments disclosed herein, the actively filled and passively filled chambers can be configured to create the same displacement/buoyancy as a conventionally designed (i.e., single chamber) flotation element, while requiring significantly less air or gas to be supplied from the user to the flotation element.

Any flotation device or inflatable device embodiments disclosed herein can have a multi-chamber or a dual-chamber flotation element having an overall size (including the outer diameter), water displacement, and buoyancy equivalent to a flotation device having a conventional single chamber air bladder, but wherein the multi-chamber or a dual-chamber flotation element uses significantly less compressed gas to reach an operable state. The current prototype derives 44% of its inflated volume from compressed gas, as compared to 100% needed to inflate a conventional raft design. The current novel design prototype gains 56% of its inflated volume from ambient air. Additionally, any multi-chamber flotation element or device embodiments disclosed herein can have at least two chambers wherein a failure of one of the chambers will not cause a failure of another of the chambers, so as to provide some level of redundancy and protection to the user in the event of a puncture or other failure of one of the chambers. For example, and without limitation, the flotation device can be configured such that, if a puncture occurs in an inner or an outer chamber, the other chamber can provide sufficient structure and buoyancy to provide flotation. Flotation can therefore be maintained by the undamaged chamber or, in the case of a hole between the two chambers, a combination of the two chambers.

Embodiments disclosed herein can be configured to require less air or compressed gas for inflation as compared to conventional inflatable devices, thereby reducing the size of the inflation canister and weight of the flotation device. Using a thin material for the flotation elements also can reduce the weight and bulk the flotation device. By inflating just the outer chamber(s), in some embodiments, the full flotation device footprint and displacement can be achieved, while using substantially less compressed air or CO2.

Some embodiments of the flotation device disclosed herein have a floor portion, a multi-chamber flotation element coupled with and surrounding the floor portion, the multi-chamber flotation element having an active inflation chamber having at least an inner wall and an outer wall, and a passive inflation chamber, a valve or port in fluid communication with the active inflation chamber but not the passive inflation chamber, and a valve in fluid communication with the passive inflation chamber and configured to permit ambient air to enter the passive inflation chamber when a pressure within the passive inflation chamber is less than an ambient air pressure surrounding the flotation device.

Any embodiments of the flotation devices disclosed herein can have one or more of the following components, features, or details, in any combination: (a) wherein the active inflation chamber surrounds and encloses at least a substantial portion of the passive inflation chamber; (b) wherein the active inflation chamber is configured to be inflated through the port; (c) wherein the active inflation chamber is configured to expand from a collapsed state to an expanded state as the active inflation chamber is inflated; (d) wherein the active inflation chamber is configured to expand the passive inflation chamber or cause the passive inflation chamber to expand from a collapsed state to an expanded state as the active inflation chamber is expanded; (e) wherein a volume of the passive inflation chamber is at least as large as a volume of the active inflation chamber when the passive inflation chamber and the active inflation chamber are both in a substantially expanded state; (f) wherein the volume of the passive inflation chamber is larger than the volume of the active inflation chamber when the passive inflation chamber and the active inflation chamber are both in a substantially expanded state; (g) wherein the volume of the passive inflation chamber is at least 10% larger than the volume of the active inflation chamber when the passive inflation chamber and the active inflation chamber are both in a substantially expanded state; (h) wherein the volume of the passive inflation chamber is from at least approximately 20% to approximately 30% larger than the volume of the active inflation chamber when the passive inflation chamber and the active inflation chamber are both in a substantially expanded state; (i) wherein the volume of the passive inflation chamber is at least 55% of the total volume of the multi-chamber flotation element when the multi-chamber flotation element is in a substantially expanded state; (j) wherein the volume of the passive inflation chamber is at least 70% of the total volume of the multi-chamber flotation element when the multi-chamber flotation element is in a substantially expanded state; (k) wherein a volume of the active inflation chamber is no more than approximately 50% of the total volume of the multi-chamber flotation element when the multi-chamber flotation element is in a substantially expanded state; (l) wherein a volume of the active inflation chamber is approximately 44% or less than of the total volume of the multi-chamber flotation element when the multi-chamber flotation element is in a substantially expanded state; (m) wherein a volume of the passive inflation chamber is at least as large as a volume of the active inflation chamber when the multi-chamber flotation element is in a substantially expanded state; (n) wherein a substantially expanded state is wherein the active inflation chamber and the passive inflation chamber are each expanded to at least 90% of a maximum volume of each of the active inflation chamber and the passive inflation chamber; (o) wherein the valve is configured to prevent air from passing from the passive inflation chamber to the ambient air; (p) wherein at least 70% of the surface area of the passive inflation chamber is surrounded or covered by the active inflation chamber; (q) wherein at least 80% of the surface area of the passive inflation chamber is surrounded or covered by the active inflation chamber; (r) wherein at least 90% of the surface area of the passive inflation chamber is surrounded or covered by the active inflation chamber; (s) wherein at least 95% of the surface area of the passive inflation chamber is surrounded or covered by the active inflation chamber; (t) wherein the entire surface area of the passive inflation chamber is surrounded or covered by the active inflation chamber; (u) further having a source of positive pressure configured to expand the active inflation chamber from the collapsed state to at least a partially expanded state upon activation of the source of positive pressure; (v) further having an automatic inflation mechanism configured to expand the active inflation chamber upon activation of the automatic inflation mechanism; (w) further having a pressurized gas cartridge configured to expand the active inflation chamber upon activation of the pressurized gas cartridge; (x) further having a pump configured to expand the active inflation chamber upon activation of the pump; (y) further having an oral inflation mechanism in fluid communication with at least one of the active inflation chamber and the passive inflation chamber; (z) wherein the multi-chamber flotation element is configured to receive air from a source of positive pressure so that additional air can be added to at least one of the active inflation chamber and the passive inflation chamber; (aa) further having a valve in fluid communication with the passive inflation chamber and configured to permit air to be added to the passive inflation chamber from a source of positive pressure; (ab) wherein the multi-chamber flotation element is configured to permit a person to blow additional air into at least one of the active inflation chamber and the passive inflation chamber; (ac) wherein a volume of the passive inflation chamber is at least as large as a volume of the active inflation chamber when the multi-chamber flotation element is in a substantially expanded state; (ad) wherein the floor portion is inflatable; (ae) further having at least one ingress orifice in said floor portion; (af) further having at least one semi-detachable flap; (ag) wherein said semi-detachable flap is reversibly manipulatable between a closed state in which said semi-detachable flap covers the ingress orifice and an open state in which said semi-detachable flap does not cover said ingress orifice; (ah) further having an opening in the floor portion that is selectively coverable with a flap, wherein the flap is deflectable, rollable, or otherwise movable from a first position in which the opening is covered by the flap to a second position in which the flap does not cover all or a portion of the opening, wherein when the flap is in the second position, a user can enter the inflatable device through the opening in the support member, and wherein the flap has a selectively reversible securing mechanism on a portion of the flap so that the flap is selectively securable in the first position; (ai) wherein the flap is selectively securable in the first position using a zipper, a hook and loop system, snaps, buttons, or other fastener or fasteners; (aj) wherein the flotation element is constructed from a high-strength material having a thickness of no greater than 20 mils and a tensile strength of at least 23 lbs. per square inch; (ak) further having a belt or a strap configured to secure the device to an individual; and (al) further having a belt or a strap configured to secure the flotation device to an individual's body.

Some embodiments of the flotation device disclosed herein have a floor portion, a first chamber coupled with the floor and expandable from a deflated state to at least an expanded state, wherein the first chamber surrounds the floor portion, a second chamber coupled with the first chamber, and a valve in fluid communication with the first chamber, wherein the first chamber is isolated from the second chamber such that the first chamber is not in fluid communication with the second chamber, and the second chamber is configured to be automatically expanded from a first collapsed state to a second expanded state when the first chamber is expanded from a first collapsed state to a second expanded state.

Some embodiments of the flotation device disclosed herein have a floor portion, and a flotation element coupled with and surrounding the floor portion, wherein the flotation element is configured to be expanded from a first state in which the flotation element is substantially collapsed to a second state in which the flotation element is substantially expanded, the flotation element defines a first volume when the flotation element is in the first state, the flotation element defines a second volume when the flotation element is in the second state, and the flotation element is configured such that at least 20% of the second volume of the flotation element is filled with ambient air drawn into the flotation element as the flotation element is being expanded from the first state to the second state.

Any embodiments of the flotation devices disclosed herein can have one or more of the following components, features, or details, in any combination: (a) wherein the flotation element is configured such that at least 40% of the second volume of the flotation element is filled with ambient air drawn into the flotation element as the flotation element is being expanded from the first state to the second state; (b) wherein the flotation element is configured such that at least 50% of the second volume of the flotation element is filled with ambient air drawn into the flotation element as the flotation element is being expanded from the first state to the second state; (c) wherein the flotation element is configured such that at least 60% of the second volume of the flotation element is filled with ambient air drawn into the flotation element as the flotation element is being expanded from the first state to the second state; (d) further having a valve or port in fluid communication with an interior chamber of the flotation element; (e) further having a compressed gas cartridge in fluid communication with an interior chamber of the flotation element; and (f) further having a one-way valve in fluid communication with an interior chamber of the flotation element, the valve configured to permit ambient air to enter the interior chamber of the flotation element as the flotation element is being expanded from the first state to the second state.

Some embodiments of a method of expanding a flotation device are disclosed herein, comprising activating a source of positive pressure coupled with the flotation device to expand a portion of an internal chamber of the flotation device with the source of positive pressure, and maintaining a valve or port in fluid communication with the internal chamber above water to permit ambient air to be drawn into the internal chamber through the one-way valve or port. In some embodiments, the valve or port can be a one-way valve or port or a two-way valve or port. The internal chamber can be divided into two or more separate chambers that are not in fluid communication with one another. Additionally, the method can further comprise coupling a source of positive pressure to the flotation device before activating the source of positive pressure.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings. Embodiments of the present disclosure will now be described hereinafter, by way of example only, with reference to the accompanying drawings in which:

FIG. 35 is a front view of an embodiment of an inflatable life preserver.

FIG. 36 is a section view of a portion of the embodiment of the inflatable life preserver shown in FIG. 35, taken through line 36-36.

FIG. 37 is a perspective view of the embodiment of the inflatable life preserver shown in FIG. 35.

DETAILED DESCRIPTION

Figure 1:
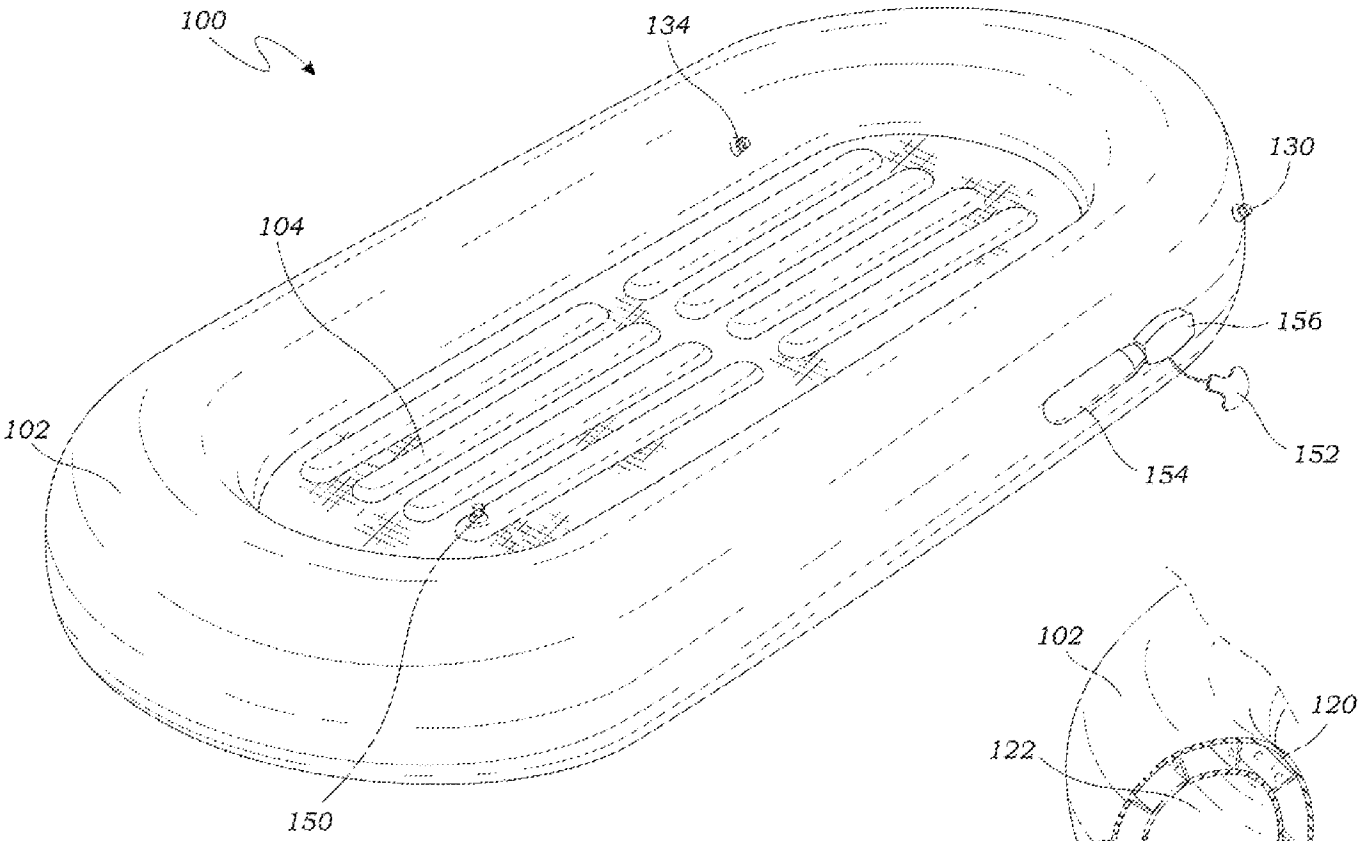
FIG. 1 is a perspective view of an embodiment of a flotation device.

Disclosed herein are embodiments of compact flotation devices that can be used as lifesaving flotation devices, recreational flotation devices such as pool flotation devices, rafts, boats, paddle boards, boats, or any other inflatable objects. Additionally, the air bladder embodiments and details disclosed herein can be used for other inflatable devices in other fields, such as air mattresses, air cushion elements for packaging, or otherwise. Current inflatable safety devices (life jackets, life rafts, life rings, etc.) are typically inflated with CO2 cylinder(s) that, once activated, force the pressurized gas into the inflatable safety device that the cylinder is connected to. These cylinders offer a specific amount of gas depending on their physical size. The larger the bottle, the more CO2, nitrogen or other gas that can be expelled from the cylinder. Conventional inflatable safety devices that are large in size, such as life rafts, require large, heavy CO2 cylinders attached to them or to fill them. The size and weight of these cylinders are a substantial portion of the size and weight of the inflatable device, particularly with an inflatable life raft.

Any of the embodiments of the flotation devices disclosed herein can be lightweight and compact personal flotation devices that are capable of providing buoyancy and reducing loss of personal thermal energy. Any embodiments of the flotation devices disclosed herein can be compact enough such that, when the flotation device is in a first, compact or collapsed state, the device can be small enough to fit inside of the user's pocket, hanging from the user's belt or other garment, and/or otherwise be compact and lightweight enough to be wearable by the user. For example, and without limitation, any embodiments of the devices disclosed herein can have a clip, a lanyard, a belt, a buckle, a strap, or otherwise that can be used to connect the flotation device to a user when the flotation device is in a compact state. Any embodiments can be configured to be small enough when in the first or pre-deployment state to be attached to a user, in a user's pocket, or otherwise coupled with the user's body, suit, uniform, or other clothing while the user performs low risk activities without interfering with the user's duties or comfort.

This is a significant advantage over conventional solutions because safety gear that can be worn routinely while performing low-risk duties is far more likely to be present and available during unforeseen emergency situations. In addition, embodiments of the flotation devices disclosed herein are configured to completely support a user out of the water, dramatically increasing survival chances, particularly in cold water.

In an emergency situation, such as a vessel sinking, aircraft downing over water or a man-overboard situation, a user can quickly inflate and deploy the buoyant apparatus. This can be accomplished in any embodiments disclosed herein by actuating a compressed gas cylinder or conventional nitrogen generator via a pull cord, letter, button, or by otherwise actuating the gas cylinder and/or the valve. Other inflation mechanisms can also be used, so long as the inflation mechanism is stable, capable of releasing or creating the proper quantity of gas to inflate the apparatus within a short period of time upon activation, and is preferably compact. In some embodiments, the apparatus can be inflated by foam or a substance expanding to a low density. Some embodiments also include ports or valves configured to permit oral inflation of at least one of the active inflation chamber and the passive inflation chamber. These maybe used as a back-up method or in extra-compact embodiments as a primary method. For example, in any embodiments disclosed herein, the foam can be a self-expanding foam that can be injected into or otherwise added into the actively expanded or filled chambers, which actively expanded chambers will be described below, to expand the actively expanded chambers. In some embodiments, the self-expanding foam can be configured to harden or become more rigid upon expansion within the one or more actively filled chambers.

Any embodiments can be configured to support at least a 150 pound person, or, in other embodiments, at least a 175 lb. person, or, in other embodiments, at least a 195 lb. person, or, in other embodiments, at least a 215 lb. person, completely out of the water. In any embodiments, the active inflation chamber can, optionally but not required, be inflated to approximately 1 psi or less, or from approximately 1 psi to approximately 2.5 psi or more.

The embodiments of the flotation devices disclosed herein can be expanded to a second, inflated or expanded state that has sufficient buoyancy to maintain the user out of the water for an extended period of time. As will be described in greater detail below, some embodiments of the flotation devices and other inflatable devices disclosed herein can have a multi-chamber air bladder. The multi-chamber air bladder can have two or more chambers. In this configuration, the multi-chamber air bladder can have one or more actively filled chambers and one or more passive filled chambers. The actively filled chambers can be filled by a source of positive pressure, such as a gas cartridge or pump. The passively filled chambers can be configured to expand and draw air into the passively filled chambers through a suitable valve (such as a one-way valve) or port as the actively filled chambers are expanded by the source of positive pressure. Stated another way, the air bladder of any of the embodiments disclosed herein can be configured such that, when one or more active air chambers are filled with positive pressure or gas, those active chambers can expand thereby causing the one or more passive chambers to also expand and draw air into the one or more passive chambers during the expansion. In any embodiments disclosed herein, one or more of the valves can be umbrella valves or otherwise be configured to prevent intake of water through the valve.

Additionally, any embodiments of the flotation devices disclosed herein can have an aspirator in conjunction with the air valve configured to communicate or channel air or compressed gas from a source of positive pressure into the active inflation chamber. The aspirator in some embodiments can be configured to draw in air in accordance with the Venturi effect, drawing in additional air into the active inflation chamber and thus further reducing the compressed air requirement.

Once inflation is initiated, the devices can be buoyant, providing the distressed individual with assistance staying at the surface of the water without exerting energy. The devices can also provide the individual the ability to fully exit the water so that the individual's body is not in direct contact with the water while waiting for assistance. A floor portion of the inflatable device, which floor portion can be inflatable or not inflatable, can be coupled with the air bladder and can be used to support the user out of the water. In embodiments having an inflatable floor portion, the floor can be configured to put at least one inch of air between the water and the occupant, acting as a thermal insulator. This can result in an increase of the survival time of individuals waiting for rescue in cooler waters and is a major improvement over conventional life vests because full exposure to even mildly cold water can quickly cause hypothermia or death. Some embodiments of the flotation devices disclosed herein, including embodiments designed for use in warm water areas, do not require an inflatable floor. However, the inflatable floor portion can also provide additional buoyancy to the device, in addition to the thermal insulating benefits of the inflatable floor portion. So, any embodiments disclosed herein can have an inflatable floor portion.

In the inflated or expanded state, the floor portion can be circumscribed, enclosed, and/or attached to the air bladder (or series of bladders) that can form a wall or gunwale. The inflatable floor can be attached to the lower inner circumference of the air bladder, creating a buoyant, thermally insulated cavity in which an individual can occupy. In any embodiments, the shape of the air bladder can be elliptical or slightly elliptical, ovular, elongated, or similar. However, in any embodiments, the air bladder and flotation devices can be any suitable or desired size or shape.

Any embodiments disclosed herein can be configured to accommodate a single person. Additionally, any embodiments disclosed herein can be configured to accommodate multiple persons.

Additionally, as will be described, any of the embodiments of the flotation devices disclosed herein can be configured to be easy to board once the flotation device is in the second, expanded state. For example and without limitation, in any embodiments, the inflatable floor can include handles or other features to assist the user to board the inflatable device, and/or an ingress orifice in at least the floor portion to facilitate boarding. In some embodiments, the ingress orifice can be covered by a semi-detachable flap. The flap can optionally be affixed in an open or closed orientation by manipulating the flap and/or the closure mechanisms. The optional ingress orifice can be configured to allow an individual to enter the apparatus through the floor rather than climbing over the air bladder. This can provide a benefit to the user by allowing the user another option beyond climbing over an air bladder and into an apparatus, which requires significant strength and effort that an individual might not have if he or she is fatigued, injured, wearing bulky gear, such as a legacy life vest, or is simply not strong enough. Failing to enter the apparatus could prove fatal depending on the temperature of the water. Additionally, any embodiments of the air bladder and the flotation device disclosed herein can be configured to have a continuous, uninterrupted air bladder and/or floor portion.

With reference to the figures, FIG. 1 shows a perspective view of an embodiment of a flotation device 100. Some embodiments of the flotation device 100 can be used as an inflatable life raft. The flotation device 100 can have a main tube or flotation element 102 (also referred to herein as a bladder member). The flotation element 102 can be configured to surround a floor 104. In some embodiments, the floor 104 (also referred to herein as a floor portion) can have one or more chambers that are inflatable. For example and without limitation, the floor 104 can have one or more chambers that are fillable with air, gas, or any other fluid or substance.

Figure 2:
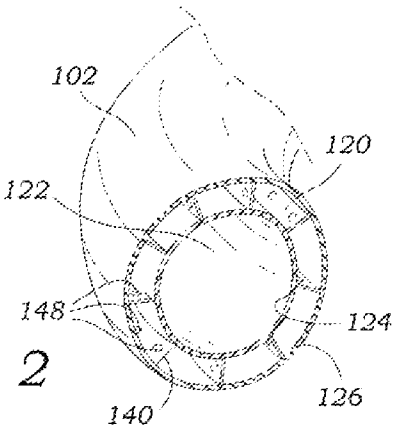
FIG. 2 is section view of a portion of the embodiment of the flotation device shown in FIG. 1.

With reference to FIG. 2, any embodiments of the flotation element 102 can have a plurality of air chambers therein. The air chambers can be fillable using one or more ports or valves. For example, and without limitation, some embodiments of the flotation element 102 can have multiple chambers (any of which can be configured to receive a supply of air, gas, or other fluid or other expanding substance, such as foam). Any embodiments of the flotation elements of any of the flotation devices disclosed herein can have an active inflation chamber (such as, without limitation, active inflation chamber 120) and a passive inflation chamber (such as, without limitation, passive inflation member 122), and any of the embodiments of the active inflation chamber 120 can have at least an inner wall 124 and an outer wall 126. In some embodiments, the active inflation chamber can surround and enclose some or all, or at least a substantial portion of, the passive inflation chamber. Further, any flotation device embodiments disclosed herein can have one or more webs or connectors that couple or connect an inner wall to an outer wall, to secure or stabilize the inner wall relative to the outer wall. Any of the connectors can have openings or holes formed therein so that the inflation gas can pass through the connectors.

For example and without limitation, as shown in FIG. 2, one or more connectors or baffles 140 can extend between the inner wall 124 and the outer wall 126. The embodiment of the flotation element 102 illustrated in FIG. 2 has nine connectors 140 extending continuously (with the exception of the holes 148 in the baffles) between the inner wall 124 and the outer wall 126. Other embodiments of the flotation element 102 can have from four to twenty or more connectors, or from seven to thirteen connectors, or from nine to eleven connectors continuously (with the exception of the holes 148 in the baffles) between the inner wall 124 and the outer wall 126. The connectors in any embodiments can be made from a thin, flexible material that can be strong enough to resist tearing during expansion of the active expansion chamber or use of the flotation device. In some embodiments, the material of the connectors can be the same material that is used for the inner and/or outer walls of the active inflation chamber.

Any embodiments can have one or more valves (such as, without limitation, valve 130 and/or valve 134) in fluid communication with the active or passive inflation chambers. For example, the valve 130 can be in fluid communication with the passive inflation chamber 122 such and isolated from the active inflation chamber. Additionally, for example and without limitation, a source of positive pressure (such as a compressed air canister or otherwise disclosed herein) can be coupled with or couplable with any of the one or more valves of the flotation device to provide positive pressure to the active inflation chamber or to the passive inflation chamber upon activation of the positive pressure source.

The flotation device can be configured to prevent air from inadvertently escaping or passing through any of the valves from one or both of the active inflation chamber and the passive inflation chamber, including valve 130 that is in fluid communication with the active inflation chamber 120 and valve 134 that is in fluid communication with the passive inflation chamber. Additionally, any embodiments can have an additional valve, such as valve 150, that is in communication with one or more inflatable chambers in a floor portion of any flotation device disclosed herein. In any embodiments, the valves can be configured to permit the intake of air, but prevent any air from passing from inside the flotation element through the valve to the atmosphere or otherwise.

Figure 17:
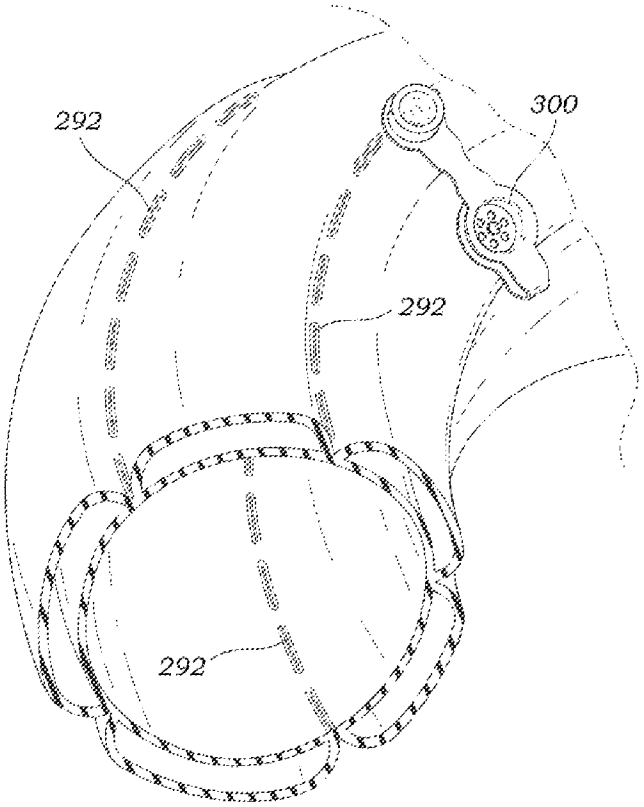
FIG. 17 is a perspective view of a section of another embodiment of a multi-chamber flotation element.
Figure 16:
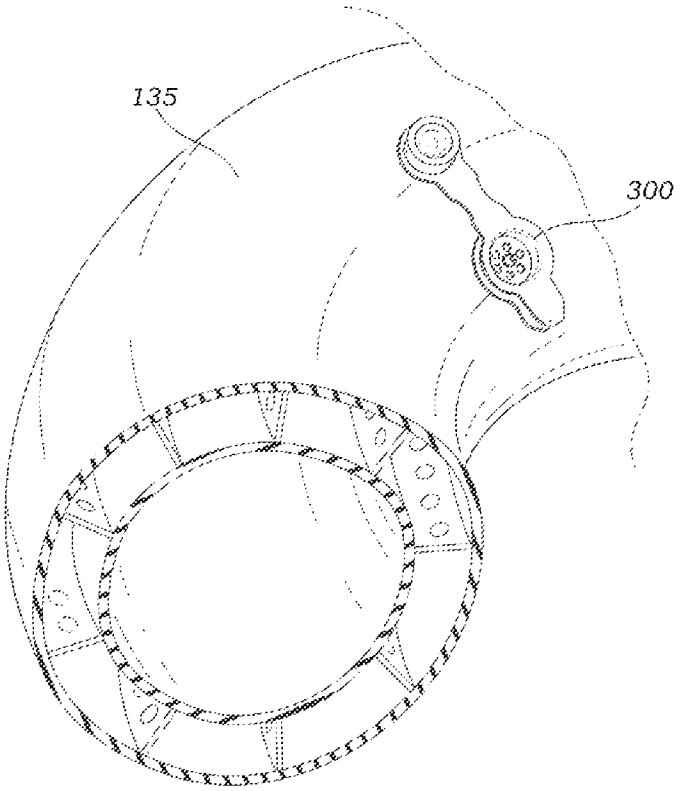
FIG. 16 is a perspective view of a section of another embodiment of a multi-chamber flotation element.

Additionally, any embodiments disclosed herein can have two or more valves in fluid communication with any of the inflatable chambers of any of the flotation devices disclosed herein. For example, and without limitation, the passive inflation chamber of any of the embodiments disclosed herein can have one or more, or two or more inflation valves configured to permit air to enter the passive inflation chamber to increase the efficiency and speed at which the passive inflation chamber is filled with ambient air. Such valves, such as without limitation the valves 300 shown in FIGS. 16 and 17 that are in fluid communication with the passive air chambers of such flotation devices) can be one-way valves or be selectively configurable to prevent air within the passive inflation chamber from escaping the passive inflation chamber through the valve. Similarly, any of the actively inflatable air chambers can have one or more valves, or two or more valves, and one, two, or more respective sources of positive pressure coupled with the valves. Further, the valve or valves in fluid communication with any of the inflatable chambers disclosed herein can be in any desired location relative to the respective inflatable chamber.

For example, any of the valves can be one-way valves, or can otherwise be configured to selectively prevent air from escaping through the valve. Any valve disclosed herein can be configured to be selectively movable or switchable between one or more open positions or states and closed positions or states. For example and without limitation, valve 130 in FIG. 1, in fluid communication with the active inflation chamber can be positioned in an open, one-way state wherein air is permitted to enter the active inflation chamber upon activation of a source of positive pressure but prevented from escaping out of the active inflation chamber through the valve (which can be used, for example, during inflation of the flotation element), a closed position or state wherein air is prevented from passing through the valve in either direction (which can be used, for example, after the flotation element is substantially inflated), and a completely open state wherein air is permitted to pass through the valve in either direction (which can be used, for example, to deflate the flotation element). In some embodiments, the valve can have a removable cap configured to selectively open and close the valve. Additionally, the valve can have movable components to selectively change the valve from one state to another.

Figure 3A:
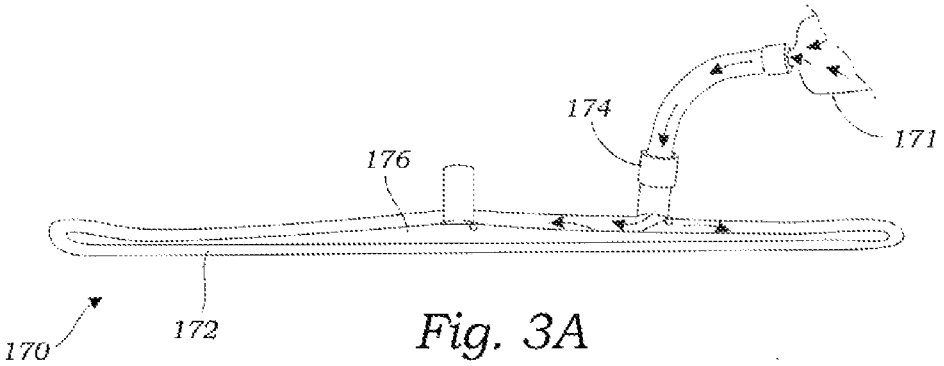
FIG. 3A shows a section view of a portion of an embodiment of a multi-chamber flotation element in a collapsed or unexpanded state, showing gas from a pressurized canister starting to inflate the active inflation chamber of the flotation element.
Figure 3B:
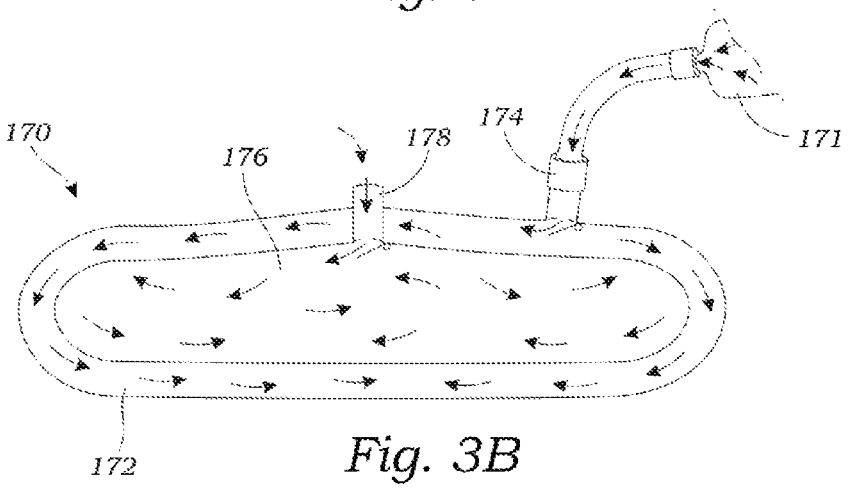
FIG. 3B shows a section view of the portion of the multi-chamber flotation element shown in FIG. 3A in a partially expanded state, showing gas from the pressurized canister continuing to inflate the active inflation chamber of the flotation element and showing ambient air being drawn into the passive inflation chamber as the active inflation chamber expands.
Figure 3C:
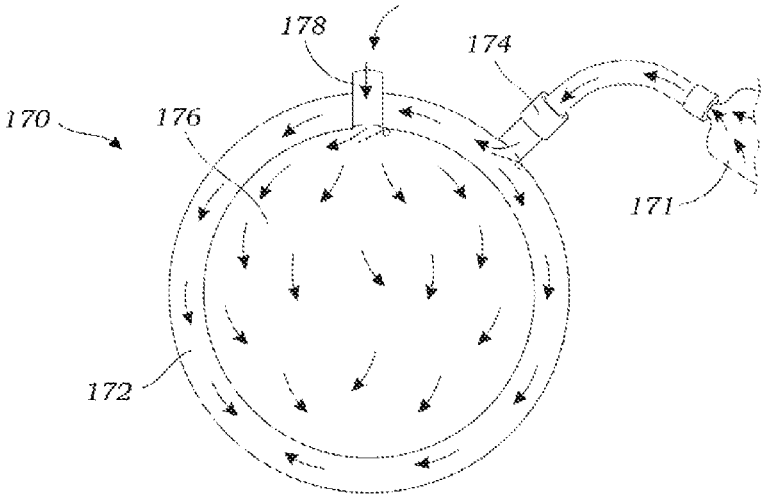
FIG. 3C shows a section view of the portion of the multi-chamber flotation element shown in FIG. 3A in a substantially expanded state, showing the active and passive inflation chambers in a substantially expanded state such that such chambers are nearly completely expanded.

FIG. 3A shows a section view of a portion of an embodiment of a multi-chamber flotation element 170 in a collapsed or unexpanded state, showing gas from a pressurized canister 171 starting to inflate the active inflation chamber 172 of the flotation element 170 through a valve 174. FIG. 3B shows the section view of the portion of the multi-chamber flotation element 170 shown in FIG. 3A in a partially expanded state, showing gas from the pressurized canister 171 continuing to inflate the active inflation chamber 172 of the flotation element 170 and showing ambient air being drawn into the passive inflation chamber 176 through the valve 178 as the active inflation chamber expands. FIG. 3C shows the section view of the portion of the multi-chamber flotation element 170 shown in FIG. 3A in a substantially expanded state, showing the active inflation chamber 172 and the passive inflation chamber 176 in a substantially expanded state such that such chambers 172, 176 are nearly completely expanded. As illustrated in the example embodiment shown in FIGS. 3A-3C, any embodiments of the flotation element disclosed herein can be configured to automatically draw air from the atmosphere surrounding the flotation element into the passive inflation chamber during inflation of the active inflation chamber. This can reduce the amount of compressed air, for example, that is required to fully or substantially fully inflate the flotation element and the flotation device and, accordingly, reduce the overall weight of the flotation device when the flotation device is in the compact state by reducing the amount and/or size of the compressed air needed to fill the flotation device. This can also have the benefit of reducing the amount of critical time needed to inflate the flotation device. When assembled as an air bladder configuration, the multi-chamber air bladder can be inserted into a conventional raft design in order to substantially reduce the amount of compressed air required to inflate the raft.

Active Inflation Volume

As mentioned, any of the embodiments of the flotation elements disclosed herein can be configured to provide comparable buoyancy relative to a conventional, single chamber air bladder, but using significantly less pressurized air or gas.

In general, in a conventional flotation device, approximately 4.5 cubic feet of air is required to sufficiently float a person of approximately 275 pounds completely out of the water, therefore approximately 4.5 cubic feet of compressed gas (typically CO2) is commonly used to achieve this buoyancy. Some embodiments of the novel flotation devices disclosed herein can use less than approximately 45% of the amount of compressed gas required in conventional flotation devices to provide the same level of buoyancy. In other words, some embodiments of the novel flotation devices disclosed herein can use less than approximately 2 cubic feet of air or compressed gas to sufficiently float a person of approximately 275 pounds completely out of the water.

Figure 4:
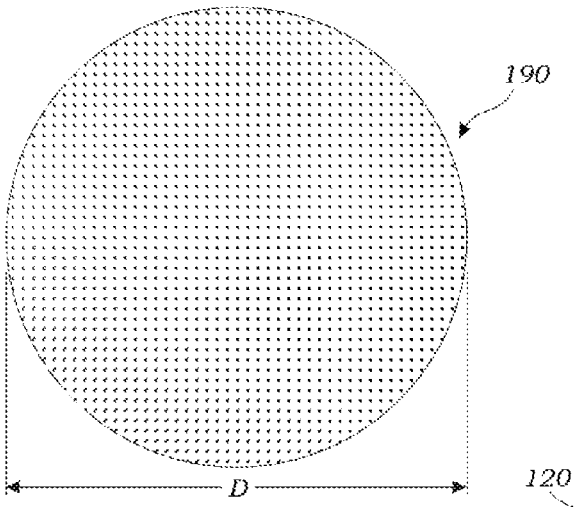
FIG. 4 shows a schematic section view of a conventional, single chamber flotation element.
Figure 5:
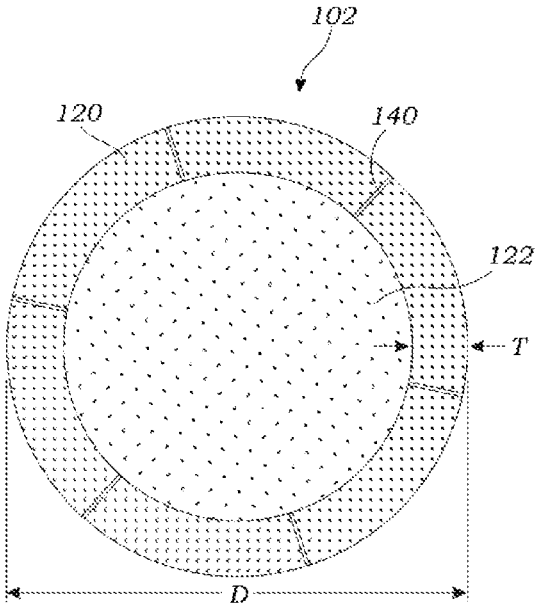
FIG. 5 shows a schematic section view of an embodiment of a multi-chamber flotation element to illustrate the relative volumes of the active and passive inflation chambers of the illustrated embodiment.
Figure 6:
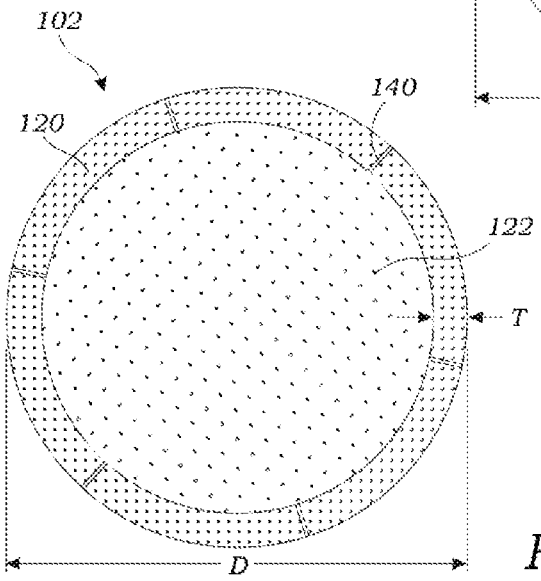
FIG. 6 shows a schematic section view of another embodiment of a multi-chamber flotation element to illustrate the relative volumes of the active and passive inflation chambers of the illustrated embodiment.

FIG. 4 shows a schematic view of a cross-section of an air bladder 190 of a conventional raft. The outer diameter D of the air bladder 190 shown in FIG. 4 is approximately 10 inches. FIG. 5 shows a schematic view of a cross-section of the embodiment of the flotation element 102 of the flotation device 100 that can be used in any of the flotation device embodiments disclosed herein. FIG. 6 shows a schematic view of a cross-section of another embodiment of the flotation element 102 that can be used in any of the flotation device embodiments disclosed herein.

In any embodiments disclosed herein, a volume of the passive inflation chamber can be at least as large as a volume of the active inflation chamber when the multi-chamber flotation element is in a substantially expanded state. Further, any embodiments can have a valve (such as a one-way valve) that is configured to prevent air from passing from the active inflation chamber to the ambient air or the source of positive pressure, and/or a valve (such as a one-way valve) that is configured to prevent air from passing from the passive inflation chamber to the ambient air.

In any embodiments, the flotation element 102 can have an outer diameter of approximately 10 inches (as shown in FIGS. 5 and 6), and an active inflation chamber 120 having a thickness T of approximately 1.0 inch, or approximately 1.25 inches (as shown in FIG. 5), or approximately 0.75 inch (as shown in FIG. 6), or from approximately 0.5 inch or less to approximately 2 inches or more, or from approximately 0.75 inch to approximately 1.5 inch, or from and to any values within these ranges.

For example and without limitation, in any embodiments, over approximately 50% of the inflatable volume of the inflation element, or from approximately 40% or less to approximately 72%, or from approximately 50% to approximately 70%, optionally 58%, or optionally 72% can be filled with air automatically drawn in from the atmosphere into one or more chambers of the inflation element during inflation or expansion of the inflation element. This can significantly reduce the amount of volume needed to be provided by the source of positive pressure in order to fill the inflatable element.

For example, in one embodiment (as shown in FIG. 5) of the inflation element 102 having an outer diameter D of approximately 10 inches, a thickness T of approximately 1.25 inches, the active inflation chamber 120 can comprise approximately 44% (or from approximately 40% to approximately 50%) of the total volume of the inflation element 102. The passive inflation chamber 122 can comprise (approximately) the balance of the total volume of the inflation element 102, or approximately 56%, or from approximately 50% to approximately 60% of the total volume of the inflation element 102. In another embodiment (as shown in FIG. 6) of the inflation element 102 having an outer diameter D of approximately 10 inches, a thickness T of approximately 0.75 inches, the active inflation chamber 120 can comprise approximately 28% (or from approximately 23% to approximately 33%) of the total volume of the inflation element 102. The passive inflation chamber 122 can comprise (approximately) the balance of the total volume of the inflation element 102, or approximately 72%, or from approximately 57% to approximately 67% of the total volume of the inflation element 102.

In any embodiments, the flotation device can be configured such that: (a) a volume of the passive inflation chamber is at least as large as a volume of the active inflation chamber when the passive inflation chamber and the active inflation chamber are both in a substantially expanded state; or (b) wherein the volume of the passive inflation chamber is larger than the volume of the active inflation chamber when the passive inflation chamber and the active inflation chamber are both in a substantially expanded state; or (c) wherein the volume of the passive inflation chamber is at least 10% larger than the volume of the active inflation chamber when the passive inflation chamber and the active inflation chamber are both in a substantially expanded state; or (d) wherein the volume of the passive inflation chamber is at least 20% larger than the volume of the active inflation chamber when the passive inflation chamber and the active inflation chamber are both in a substantially expanded state; or (e) wherein the volume of the passive inflation chamber is at least 25% larger than the volume of the active inflation chamber when the passive inflation chamber and the active inflation chamber are both in a substantially expanded state; or (f) wherein a volume of the active inflation chamber is no more than approximately 50% of the total volume of the multi-chamber flotation element when the multi-chamber flotation element is in a substantially expanded state; or (g) wherein a volume of the active inflation chamber is less than 45% of the total volume of the multi-chamber flotation element when the multi-chamber flotation element is in a substantially expanded state; or (h) wherein the volume of the passive inflation chamber is at least 55% of the total volume of multi-chamber flotation element when the multi-chamber flotation element is in a substantially expanded state; or (i) wherein the volume of the passive inflation chamber is at least 70% of the total volume of multi-chamber flotation element when the multi-chamber flotation element is in a substantially expanded state.

In some embodiments, the substantially expanded state can be wherein the active inflation chamber and the passive inflation chamber are each expanded to at least 90% of a maximum volume of each of the active inflation chamber and the passive inflation chamber, or to at least 95% of a maximum volume of each of the active inflation chamber and the passive inflation chamber.

Any embodiments of the flotation device disclosed herein, including without limitation flotation device 100, can have a port in fluid communication with the passive inflation chamber. The port can be configured to permit ambient air to enter the passive inflation chamber when a pressure within the passive inflation chamber is less than an ambient air pressure surrounding the flotation device. In other words, any embodiments of the flotation element disclosed herein, including flotation element 100, can be configured such that, as the active inflation chamber is inflated, the inflation of the active inflation chamber will cause the passive inflation chamber to expand, thereby reducing the pressure within the passive inflation chamber during expansion of the active inflation chamber to a value that is less than an ambient pressure surrounding the flotation device. This can cause ambient air to enter the passive inflation chamber through the port during expansion of the active inflation chamber and can cause the automatic and/or coincident inflation of the passive inflation chamber, thereby filling the passive inflation chamber with air from the ambient atmosphere.

In this configuration, in any embodiments, the passive inflation chamber can be configured to automatically expand from a collapsed state to an expanded state as the active inflation chamber is inflated. The active inflation chamber can be configured to automatically expand the passive inflation chamber from a collapsed state to an expanded state as the active inflation chamber is inflated and expanded. The active inflation chamber can be configured to expand from a collapsed state to an expanded state by the source of positive pressure.

In any embodiments disclosed herein, the passively filled or expanded chamber can be substantially or completely surrounded by, covered by, or encapsulated by the actively filled chamber, or the passively filled chamber can be only partially covered by or adjacent to and coupled with the actively filled chamber. For example and without limitation, the flotation element of any of the embodiments disclosed herein can be configured such that at least 40% (or approximately 50%), or at least 50% (or approximately 50%), or at least 60% (or approximately 60%), or at least 70% (or approximately 70%), or at least 85% (or approximately 85%) of the surface area of the passive inflation chamber is surrounded or covered by the active inflation chamber. Further, for example and without limitation, the flotation element of any of the embodiments disclosed herein can be configured such that from 30% (or approximately 30%) to 100% (or approximately 100%), or from 40% (or approximately 40%) to 70% (or approximately 70%), or from 70% (or approximately 70%) to 100% (or approximately 100%) of the surface area of the passive inflation chamber, or from 85% (or approximately 85%) to 95% (or approximately 95% or at least 95%) of the surface area of the passive inflation chamber is surrounded or covered by the active inflation chamber.

Figure 7:
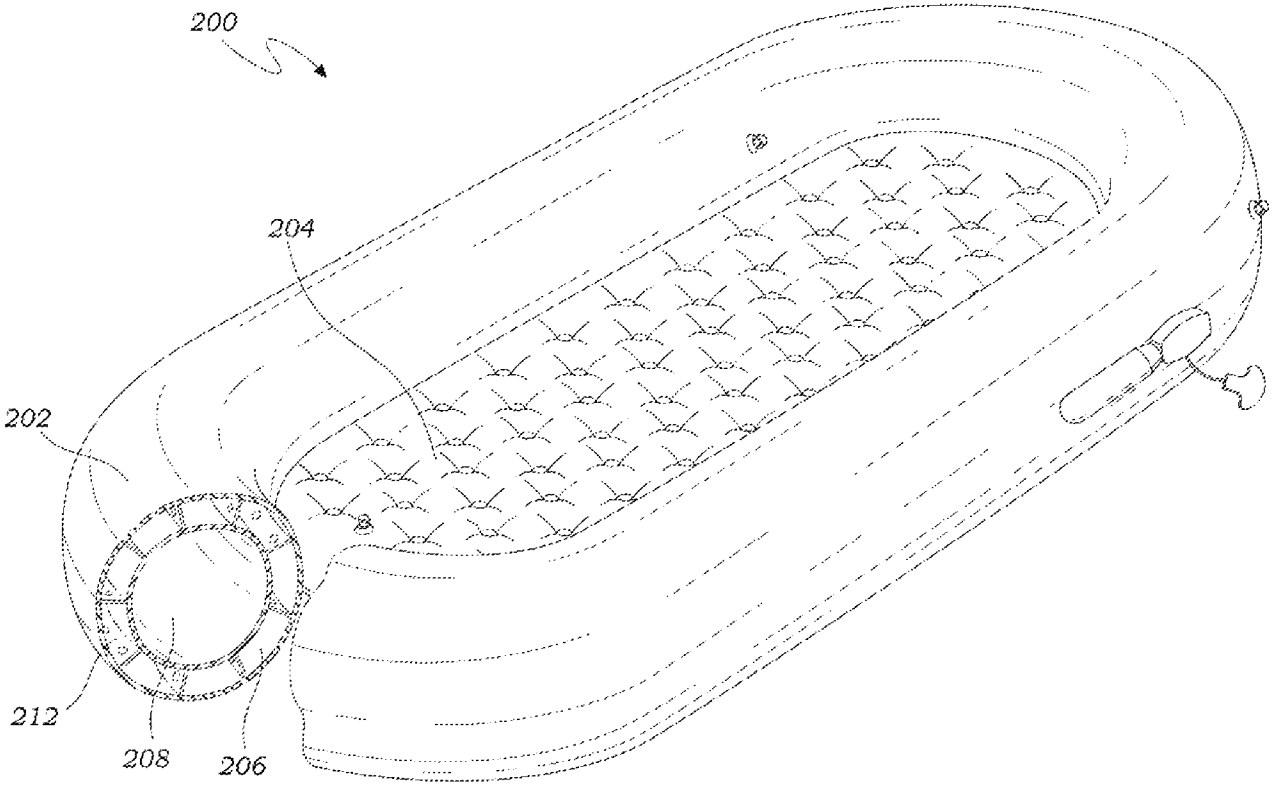
FIG. 7 is a perspective view of another embodiment of a flotation device, showing a portion of the flotation element in section view.

FIG. 7 is a perspective view of another embodiment of a flotation device 200, showing a portion of the flotation element in section view. The embodiment of the flotation device 200 can have any of the components, features, and/or other details of any other embodiments of the flotation devices or other embodiments of the sub-components usable with any of the flotation device embodiments disclosed herein, including without limitation any of the components, features, and/or other details of the flotation device 100 disclosed herein. Additionally, any of the other embodiments of the flotation devices disclosed herein can have any of the components, features, and/or other details of any other embodiments of the flotation devices or other embodiments of the sub-components usable with any of the flotation device embodiments disclosed herein, including without limitation any of the components, features, and/or other details of the flotation device 200.

Flotation device 200 in FIG. 7 can have a flotation element 202 and a floor portion 204 that can have button welds (such as button welds 290 shown in FIG. 15) or continuous or intermittent seam welds (such as the seam welds 292 shown in FIG. 17) that couple opposing walls of the inflatable chamber of the floor portion together. Because of the spacing between the intermittent welds, air can pass from one chamber portion to another through such spaces to fill all of the chamber portions. Additionally, the flotation element 202 can be a multi-chamber inflation element, having an active inflation chamber 206 or chambers surrounding a passive inflation chamber 208 or chambers, and a plurality of baffles 212 interconnecting the walls of the passive and active inflation chambers.

Figure 9:
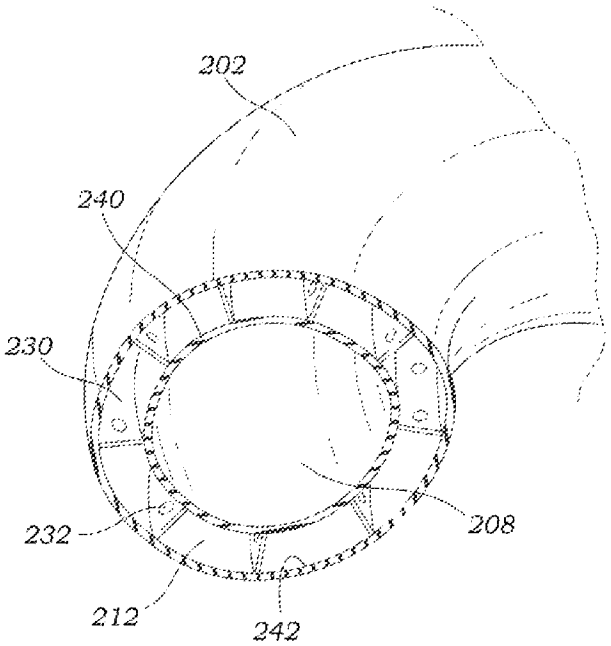
FIG. 9 is section view of a portion of an embodiment of a multi-chamber flotation element.
Figure 8:
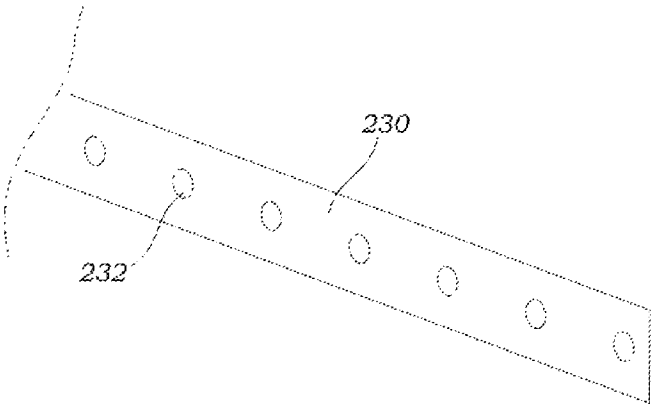
FIG. 8 is a perspective view of an embodiment of a gusset member having openings therethrough.

Construction of the Flotation Device:

FIG. 8 is a perspective view of an embodiment of a gusset or gusset member 230 having openings 232 therethrough. FIG. 9 is section view of a portion of an embodiment of a multi-chamber flotation element 202 having gussets 230 coupled with the inner wall 240 and outer wall 242 of the flotation element 202. Any flotation element embodiments disclosed herein can have multiple baffles that can extend between the inner wall and the outer wall of the flotation element. The flotation element can be made by welding, adhering, fusing, bonding, or otherwise coupling one or multiple baffles between the walls of the flotation element. One or more openings can be formed in the baffles (optionally, a plurality of openings) to allow air or gas to pass through the baffles. The baffles can be made from the same material as used to manufacture the inner and/or outer walls of the flotation element.

Figure 11:
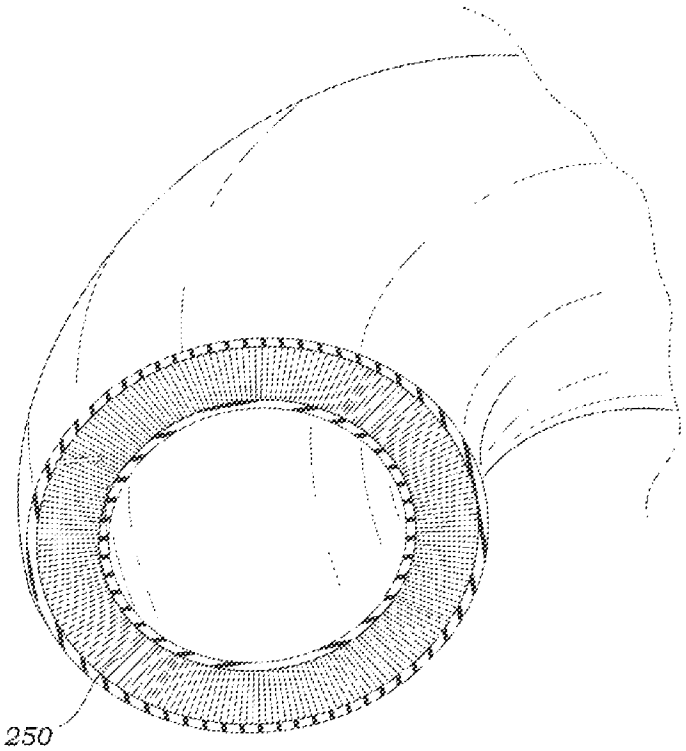
FIG. 11 is a perspective view of a section of an embodiment of a multi-chamber flotation element having a drop-stitch baffle component or interconnection.
Figure 10:
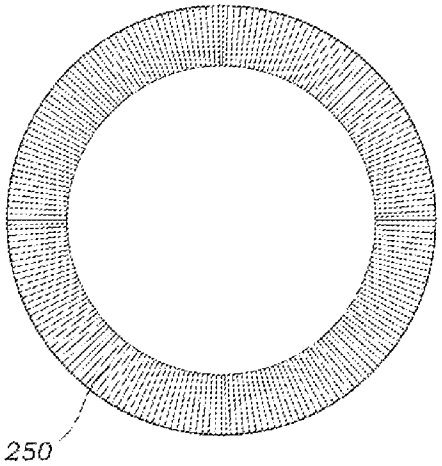
FIG. 10 is an end view of an embodiment of a drop-stitch baffle component that can be used to interconnect the inner and outer walls of any embodiments of a multi-chamber flotation element disclosed herein.
Figure 13:
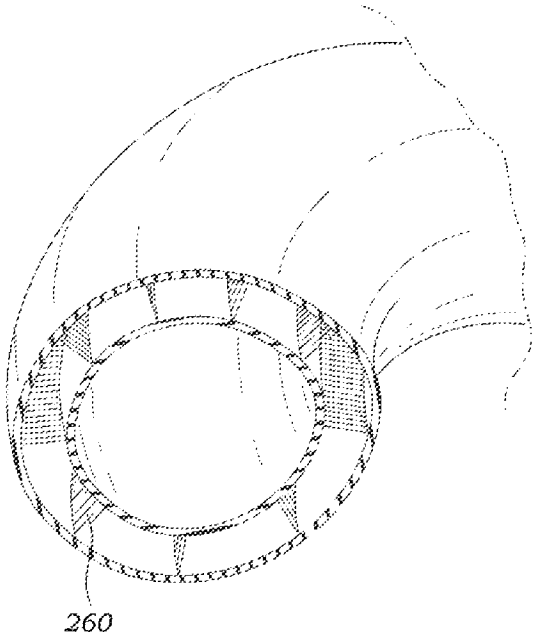
FIG. 13 is a perspective view of a section of an embodiment of a multi-chamber flotation element having a webbed gusset member.
Figure 12:
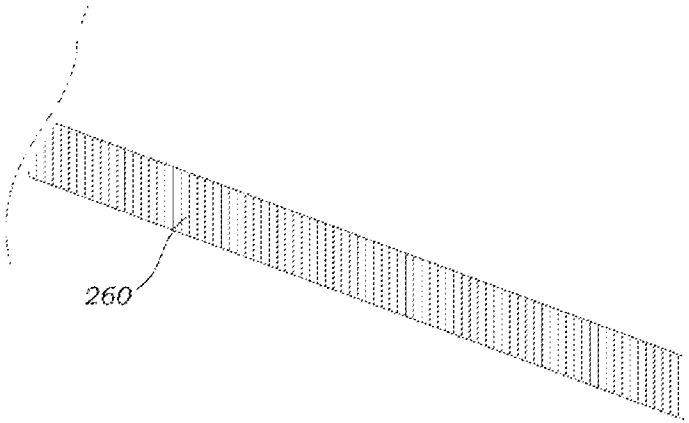
FIG. 12 is a perspective view of an embodiment of a webbed gusset member.

In other embodiments, the interconnection 250, such as those shown in FIGS. 10 and 11, between the inner and outer walls of the flotation element can comprise a layer or array of thin threads that are coupled with the inner and outer walls or other adjacent walls of the inflation element. FIG. 10 is an end view of an embodiment of a drop-stitch baffle component or interconnection 250 that can be used to interconnect the inner and outer walls of any embodiments of a multi-chamber flotation element disclosed herein. FIG. 11 is a perspective view of a section of an embodiment of a multi-chamber flotation element having a drop-stitch baffle component or interconnection 250. Just as with other baffles disclosed herein, the drop-stitch baffle component or interconnection 250 can be configured to couple the inner wall with the outer wall of the flotation element, so that the inner wall is pulled and expanded outwardly as the outer wall is expanded, thereby causing the expansion of the passive or inner inflation chamber. Additionally, the drop-stitch baffle component or interconnection can permit air or expansion gas to pass through the baffle component so as to fill other portions of the chamber. The drop-stitch baffle component can be a lower weight and volume as compared to a solid baffle. The drop-stitch baffle component can extend lengthwise between the inner and outer walls (as shown in FIGS. 12 and 13), can extend circumferentially between the inner and outer walls, can sporadically but continuously interconnect the inner and outer walls, or otherwise. The drop-stitch baffle components can be welded, glued, or otherwise joined or coupled with the inner and outer walls.

Means of Creating Pressurized Chamber

As described, any embodiments of the flotation elements disclosed herein can have a plurality of baffles that are evenly spaced or spaced asymmetrically to allow for other design considerations, such as the placement of a bulkhead in the flotation element. These baffles can have holes to permit passage of compressed gas between each cavity that is created by multiple baffles. If multiple pressurized chambers are desired, baffles without holes can be used so that the desired chamber size is created. Each baffle can be welded to the outer layer of material and to an inner layer to create the desired structure. The number of baffles can affect the amount of support between the two or more layers of material joined by the baffles and similarly how much material is required for the baffles.

Additionally, drop stitching can be used to create an inflatable structure that maintains a generally uniform shape and that can handle a higher pressure. Additionally, the drop stitching can improve the rigidity of the device. In some embodiments, hundreds or thousands of low-stretch threads can be sewn between two layers of material, such as the inner and outer walls, to join the two layers of material together and create a desired shape. Because these two material layers have been stitched hundreds or thousands of times, the material can then be treated with an air-tight coating to create a leak-proof structure. Alternatively, an outer layer of material can be bonded to the base layers to maintain an airtight structure.

Another means of constructing the pressurized chamber of the inflatable structure comprises the use of many threads that form supports between an outer layer of material (such as an outer wall of the flotation element) and an inner layer of material (such as an inner wall of the flotation element). If the outer chamber is required to have multiple chambers, two or more baffles without holes can be used to create these chambers.

Webbed supports can also be used. Webbed supports can be made of cross-linked threads or similar material in order to provide more torsional support between the two layers of material that create the pressurized chambers of the inflatable structure. The webbed supports can be used to create an outer chamber of compressed gas in the inflatable structure. Two or more baffles without holes can be used if multiple chambers are desired between the outer layer of material and the inner one.

Another technique for constructing the inflatable structure of any of the embodiments disclosed herein can include welding periodically spaced supports to the inside and outside layers of material that form the outer chamber(s). These periodically spaced supports can create a common cavity within the outer chamber of the inflatable structure. Two or more full length baffles without holes can be welded in place if multiple cavities are required in the outer chamber.

Spot welds can also be used to connect two or more pieces of material, or two or more layers of material (including the outer layer of material and the inner layer of material) in any embodiments disclosed herein, thereby forming the outer chamber of the inflatable structure. These spot welds can be evenly spaced to create a uniform thickness of the outer chamber. Alternatively, the spot welds can be unevenly spaced to create varying thicknesses in the outer chamber. The distance between spot welds can determine the thickness of the outer chamber. Two or more baffles without holes can be welded in place between the inner and outer layers of material to create multiple chambers within the outer chamber.

Similar to spot welds, linear or other shaped welds can be used to connect two or more pieces of material, or two or more layers of material (including the outer layer of material and the inner layer of material) in any embodiments disclosed herein. The spacing of these welds determines the thickness of the outer chamber, so a uniform thickness or varying thickness can be achieved. Two or more baffles without holes can be welded in place between the inner and outer layers of material to create multiple chambers within the outer chamber. Alternatively, a continuous weld can be used to close off one section from another, thus creating multiple chambers.

Figure 15:
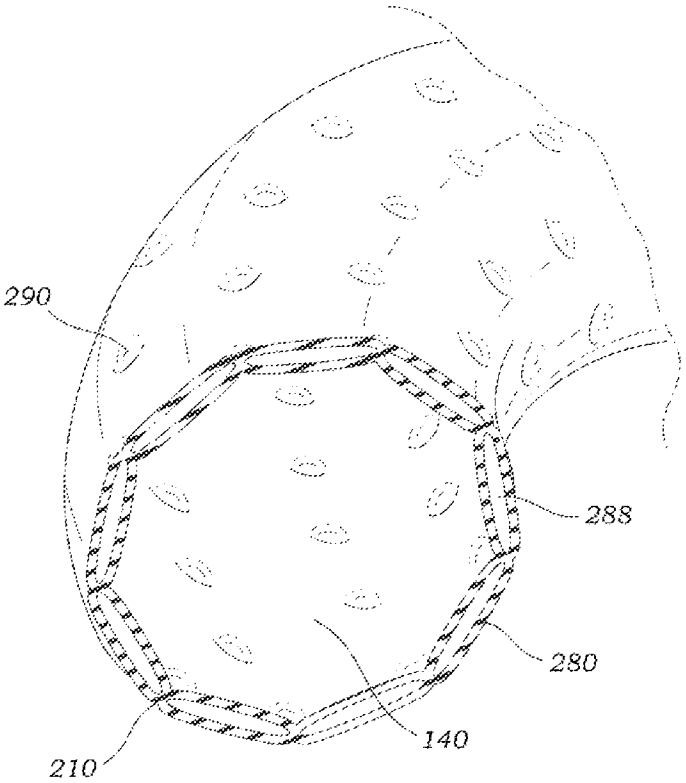
FIG. 15 is a perspective view of a section of the embodiment of a multi-chamber flotation element illustrated in FIG. 14.
Figure 14:
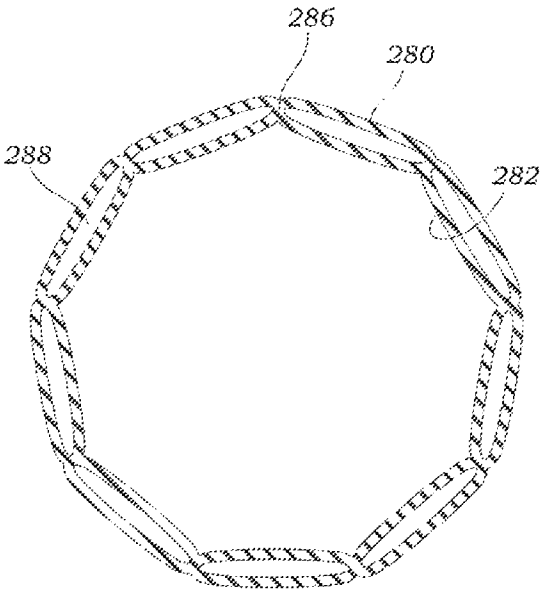
FIG. 14 is an end view of another embodiment of a multi-chamber flotation element.

In some embodiments, with reference to FIGS. 14 and 15, the outer layer 280 can be welded or otherwise joined to the inner layer 282 in periodic spot welds or linear welds 286 to create the outer or active inflation chamber or chambers 288.

Some embodiments of the flotation devices disclosed herein can be manufactured using radio-frequency welding, ultrasonic welding, thermal sealing, stitching or other adhering or joining methods. Lap joints or other joints, seals, and other connections can be made using any of the foregoing techniques, including radio-frequency welding.

Any components of the inflatable devices disclosed herein can be made of thin flexible material (such as polyurethane, or other flexible, thin plastic). Further, any suitable methods or techniques may be used to seal or join the material, including RF (Radio Frequency) or Ultrasonic Welding, gluing, or otherwise. A similar bottom half of the inflatable raft can be welded to the top half to create a cohesive inflatable device. The valve/actuator assembly and the one-way valve can be welded into place. The inflation cylinder and additional optional components such as hand holds, a safety line, etc. can also be coupled the inflation element, the floor portion, or otherwise. The raft, or other inflatable safety device can now be fully inflated with substantially less compressed air.

Source of Positive Pressure and Activation Thereof:

In any embodiments disclosed herein, the source of positive pressure, which can be a gas canister or cylinder, can be activated using a pull tab, such as the pull tab 152 shown in FIGS. 1 and 7. In this configuration, when a user pulls on the pull tab or otherwise activates an actuator, the source of pressure can cause the inflatable flotation device to automatically expand from a compact, collapsed state to an inflated, expanded state. In any embodiments, the source of positive pressure can be a gas canister, such as the compressed gas canister 154 shown in FIGS. 1 and 7 that is coupled with the actuator valve 156 that is coupled with an outside surface of the flotation device. The actuator valve can be configured such that, when the actuator 152 is actuated, the gas from the source of positive pressure (which can be a compressed gas canister) is released into the active inflation chamber through the valve that forms part of the actuator valve. In this arrangement, the actuator can be used to open the valve to allow the release of the air from the source of positive pressure into the flotation element. The valve 156 can be a one-way valve that is configured to prevent air from inadvertently escaping from the active inflation chamber through the valve 156.

Any embodiments of the flotation devices disclosed herein can be configured to have multiple valves for intake of air into the passive inflation chamber. Additionally, in some embodiments, it may be beneficial to position a valve for intake of air into the passive inflation chamber adjacent to or near to the valve used for inflation of the active inflation chamber so that, as expansion forces are exerted on the passive inflation chamber by the influx of air or gas into the active inflation chamber through the active inflation chamber intake valve, the passive inflation chamber can draw air into that region to permit the expansion of that region of the passive inflation chamber experiencing the expansion forces.

Additionally, any embodiments of the flotation devices disclosed herein can be configured to have one or more oral inflation valves or ports configured to permit a user to orally add more gas to the flotation element. For example, and without limitation, the floor portion of any embodiments disclosed herein can have an oral inflation mechanism configured to permit a user to inflate such floor portion orally. The flotation device can have one or more oral inflation valves in fluid communication with one or more of the active inflation chambers and/or one or more of the passive inflation chambers. Once the apparatus is in a substantially inflated state, the oral inflation elements can be used to top off the pressure in the one or more air chambers.

Further, as described, in any embodiments, during the inflation phase of any of the flotation device embodiments disclosed herein, the suction caused by the expansion of the one or more passive inflation chambers can cause ambient air to be drawn into the one or more passive inflation chambers through the one or more intake ports and coincident valves until the one or more passive inflation chambers are at least partially inflated. Once the flotation device is in this state, the flotation device can either be used as-is, or the one or more passive inflation chambers can be topped off orally, via the one or more ports in fluid communication with the one or more passive inflation chambers, via an additional gas cylinder, via an integrated pump, or via an actuator/valve combination. In some embodiments of the flotation devices, it may be beneficial to have a pressure valve between the active inflation chamber and the passive inflation chamber in order to permit excess pressure to bleed off from the active inflation chamber to the passive inflation chamber, thus increasing the pressure of the passive chamber.

Flap Details:

The semi-detachable flap can be configured to be easily opened, allowing for entry into the apparatus from underneath the flotation device, and may be securely reattached, thereby resuming its function as a further portion of the structurally secured and thermally insulated floor. A wide variety of reversible securing mechanisms can be utilized to facilitate the semi-detachable flap's capability. A preferred embodiment features a high strength plastic zipper; however, other mechanisms are acceptable as well, such as, hook and loop systems, snaps, or buttons, any of which can be used with any of the embodiments disclosed herein.

In some embodiments, the flap can be approximately 15 to 24 inches wide, or, in some embodiments, approximately a width of the floor portion, allowing the user to easily board the raft by lifting himself or herself out of the water, for example and without limitation with one hand on each tube, once he has entered the orifice. The apparatus is designed so that an individual entering the apparatus through the ingress orifice can climb on the inflatable floor, which should be located just above the water level, thereby requiring minimal effort. This is an important feature, because a sufficiently wide ingress orifice allows and individual to position himself square to the inflatable floor while boarding, thereby distributing his or her weight equally and reducing the possibility that the apparatus will tip or roll during boarding. In a preferred embodiment, the orifice should between 20 to 36 inches in the opposing direction (length) so that an individual can climb through the ingress orifice created, by opening the semi-detachable flap with ease, especially when wearing other safety gear such as a legacy life vest.

To board the apparatus, an individual can either dive under the inflated apparatus and emerge with his or her body through the ingress orifice, or enter the apparatus without putting his or her head below water, such as when the individual is wearing a life vest, the individual can lift the apparatus off the water by pressing upward on one end of the air bladder and lower the apparatus over his or her head.

Air Bladder Segment:

Some embodiments can include an air bladder segment located adjacent the ingress orifice, thereby increasing the ease with which the apparatus can be lifted, by increasing flexibility of the air bladder at the segment. Embodiments of the flotation device having an air bladder segment can be configured such that an individual can lift one end of the air bladder while the other end of the air bladder stays level with the water or such that one end of the air bladder is easier to lift out of the water due to the added flexibility of the air bladder segment. Such a configuration can make the flotation device easier to lift and/or manipulate during boarding, thereby facilitating boarding.

Once an individual is positioned with his or her body through the ingress orifice, the individual can fully board the apparatus by pressing down on each side of the air bladder or simply crawling onto the inflated floor. As mentioned, any embodiments can include any of a variety of loops, handles, or gripping points to assist boarding. After the device is fully boarded, the semi-detachable flap may be closed and reattached, thereby preventing water from splashing into the apparatus through the orifice and also thereby creating more floor space.

Split Air Bladder

In another embodiment of the flotation device, the air bladder can be configured to have a break or separation in the air bladder such that the air bladder does not continuously circumscribe the inflatable floor. In this configuration, the floor portion can be continuous and uninterrupted—i.e., the floor portion can be without an ingress orifice. The break or separation in the air bladder can be formed by distal ends of the air bladder that tightly abut one another. In some embodiments, the inflatable floor can have a semi-detachable slit. When the semi-detachable slit is in the attached orientation, the distal ends of the air bladder can tightly abut each other, acting as a continuous gunwale. Further, the air bladder can be configured such that, when the semi-detachable slit is in the open orientation, the distal ends of the air bladder can be horizontally separated by an individual, creating space to board the apparatus between the distal ends of the air bladder.

Once the individual is securely aboard, the semi-detachable slit in the inflatable floor can be returned to the attached orientation and the air bladder can be configured such that the distal ends of the air bladder orient securely abut each other, again creating a continuous gunwale. Any embodiments of the semi-detachable slit can utilize a reversible attachment system, for example and without limitation a high strength plastic zipper, although other reversible fasteners will work as well, such as a sliding fastener, hook and loop systems, or buttons.

Figure 18:
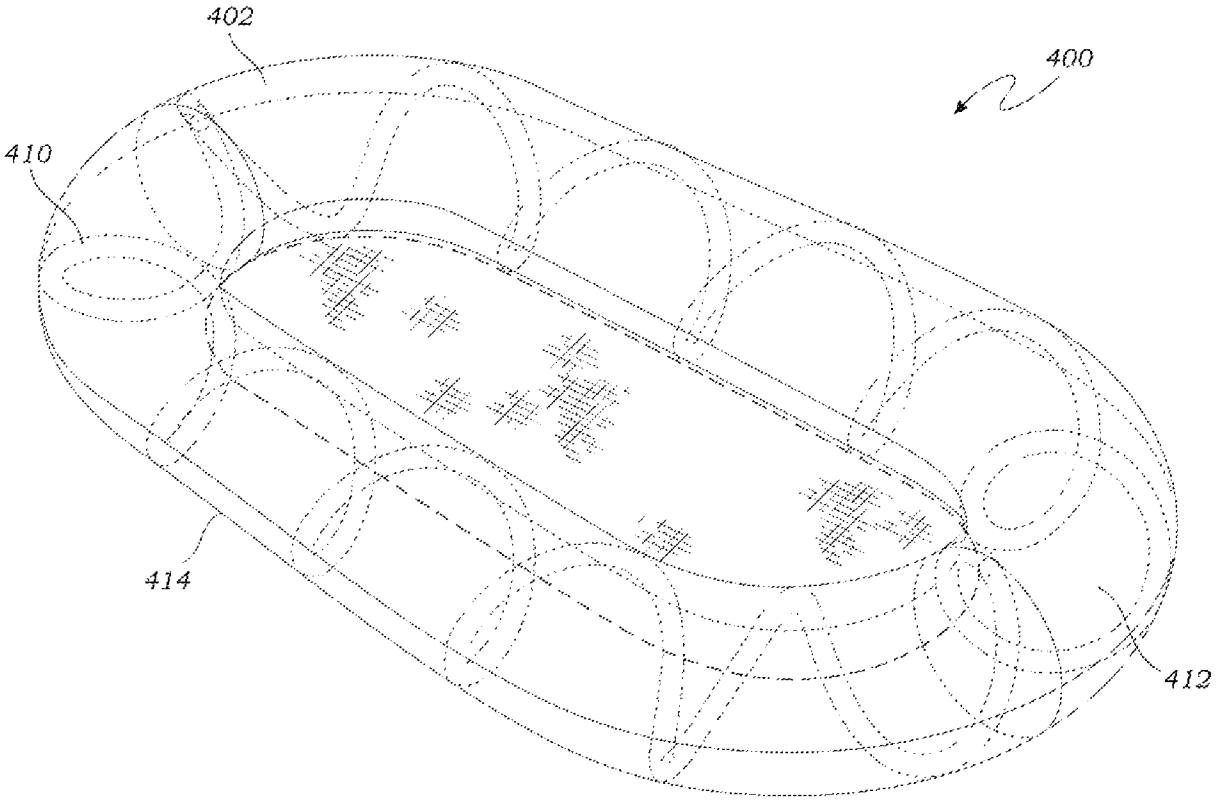
FIG. 18 is a perspective view of another embodiment of a flotation device, showing an embodiment of an inflatable element having a coiled or helical shape in the interior of the flotation device.
Figure 19:
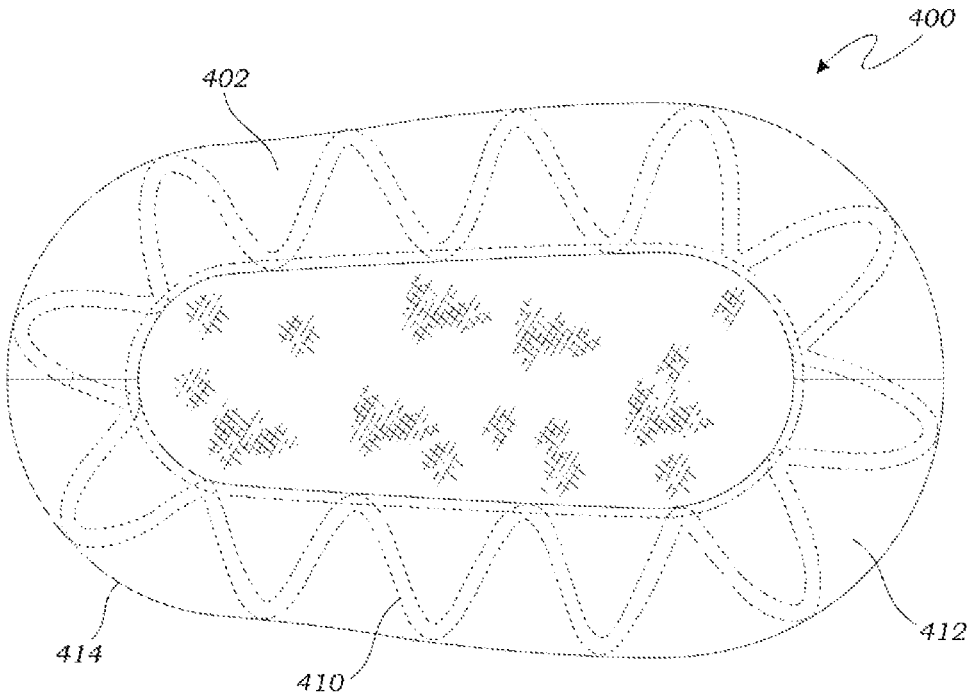
FIG. 19 is a top view of an embodiment of the flotation device shown in FIG. 18.
Figure 20:
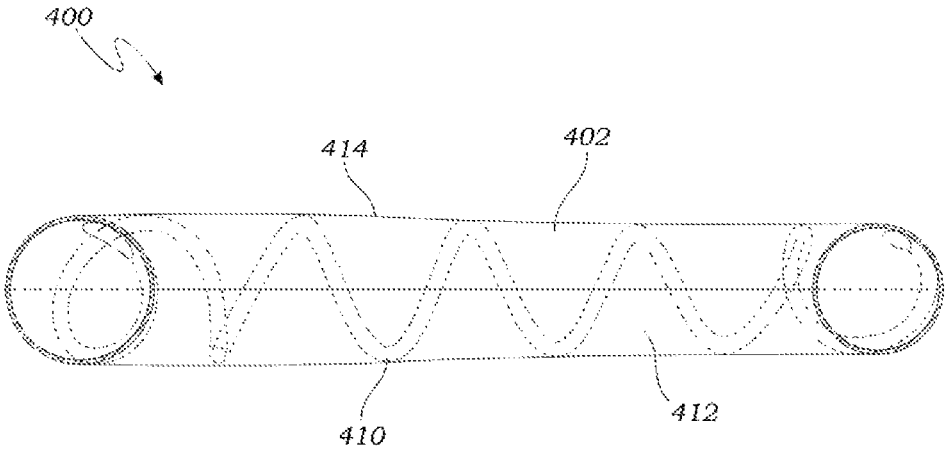
FIG. 20 is a section view of a portion of the embodiment of the flotation device shown in FIG. 19.

FIGS. 18 and 19 are a perspective view and a top view of another embodiment of a flotation device 400. Some embodiments of the flotation device 400 can be used as an inflatable life raft. FIG. 20 is a section view of a portion of the embodiment of the flotation device 400 shown in FIG. 18. With reference to FIGS. 18-20, any embodiments of the flotation element 402 can have a plurality of air chambers therein. The air chambers can be fillable using one or more ports or valves. For example, and without limitation, some embodiments of the flotation element 402 can have multiple chambers, any of which can be configured to receive a supply of air, gas, or other fluid or other expanding substance, such as foam. The flotation element 402 can have an active inflation chamber (such as, without limitation, active inflation chamber 410) and a passive inflation chamber 412. In some embodiments, the active inflation chamber can have a coiled tube configuration (which can be helically coiled) that expands when inflated with a source of positive pressure, thereby expanding the passive inflation chamber 412. The passive inflation chamber 412 can be surrounded by an outer wall or outer layer of material 414 which can surround and enclose the passive inflation chamber 412.

In some embodiments, this coiled tube active inflation chamber 410 can be formed as part of the outer layer 414 of the flotation element 402. In this configuration, one side of the active inflation chamber 410 can be the outer wall 414 of the flotation element 402 and the other side or portion of the active inflation chamber (or tube thereof) can be a separate layer that can be welded in place. In other embodiments of the coiled tube active inflation chamber, the tube forming the active inflation chamber can be a separate element or piece of material that forms an inflation chamber. This tube can be attached to the interior surface of the outer layer 414 by radio frequency welding, ultrasonic welding, gluing, heat welding, stitching, or other suitable joining means.

Figure 21:
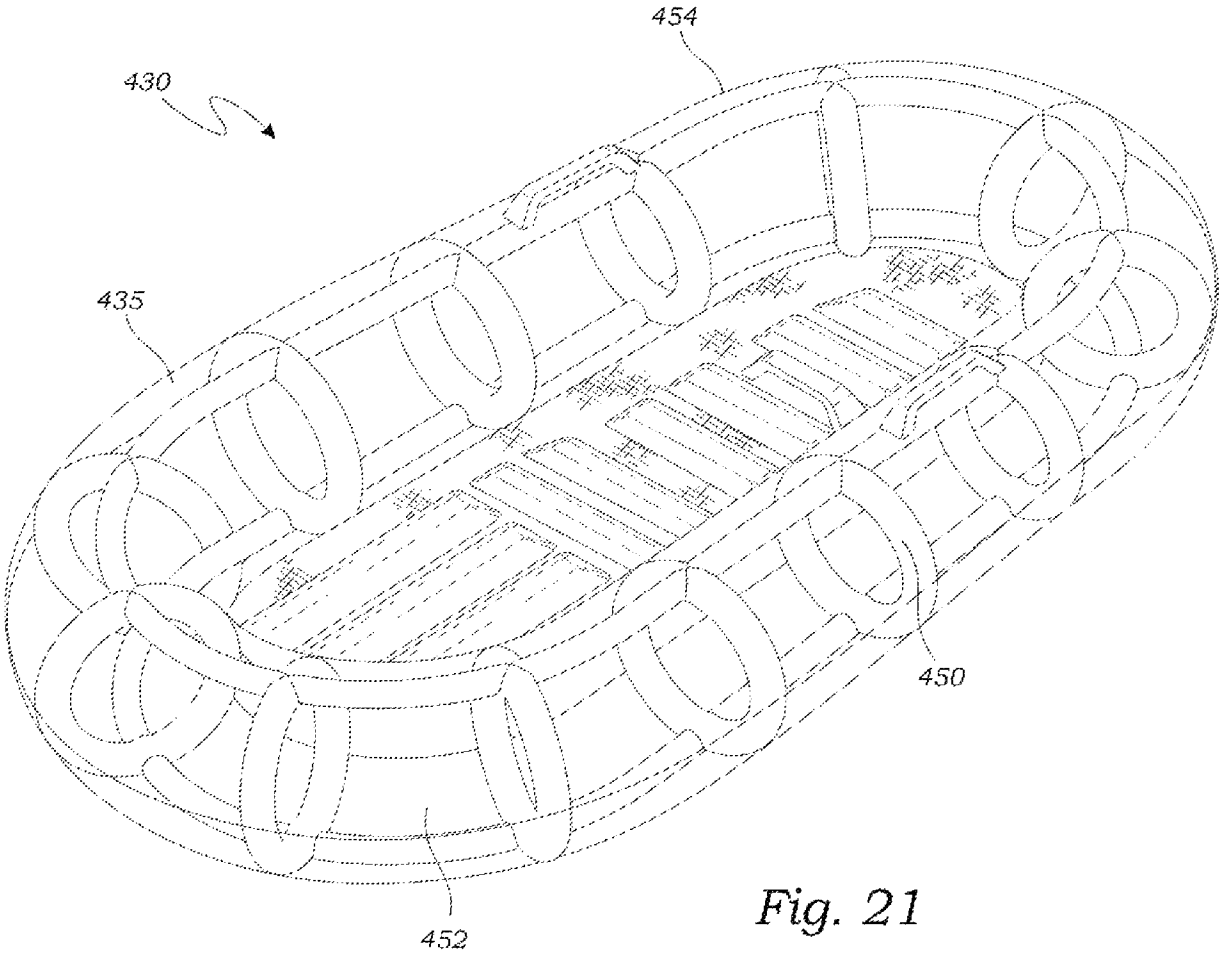
FIG. 21 is a perspective view of another embodiment of a flotation device, showing an embodiment of a flotation element substantially inflated.

FIG. 21 is a perspective view of a flotation device 430. Some embodiments of the flotation device 430 can be used as an inflatable life raft. Any embodiments of the flotation element 435 can have a plurality of air chambers therein. The air chambers can be fillable using one or more ports or valves. For example, and without limitation, some embodiments of the flotation element 435 can have multiple chambers (any of which can be configured to receive a supply of air, gas, or other fluid or other expanding substance, such as foam). Any embodiments of the flotation elements of any of the flotation devices disclosed herein, including the flotation element 435, can have an active inflation chamber such as, without limitation, active inflation chamber 450 and a passive inflation chamber 452. In some embodiments, the active inflation chamber can be a tube configuration that expands when inflated with a source of positive pressure. The passive inflation chamber 452 can be surrounded by an outer wall or outer layer of material 454 which can surround and enclose the passive inflation chamber 452. In some embodiments, outer wall 454 can surround and enclose some or all, or a small portion of, the passive inflation chamber.

In some embodiments, the active inflation chamber 450 can be formed in part using the interior side of the outer wall or layer 454 of the flotation element 435. In this configuration, one side of the active inflation chamber 450 can be the outer wall 454 of the flotation element 435 and the other side of the active inflation chamber 450 can be made from a separate layer of material that can be welded to, adhered to, or otherwise coupled with the outer layer 454. In other embodiments, the active inflation chamber can be made from a separate tube or piece of material that can be completely separate from the outer layer 454. This tube can be attached to the interior side of the outer layer 454 of the flotation element 435 by radio frequency welding, ultrasonic welding, gluing, heat welding, stitching, or other suitable joining means.

Figure 22:
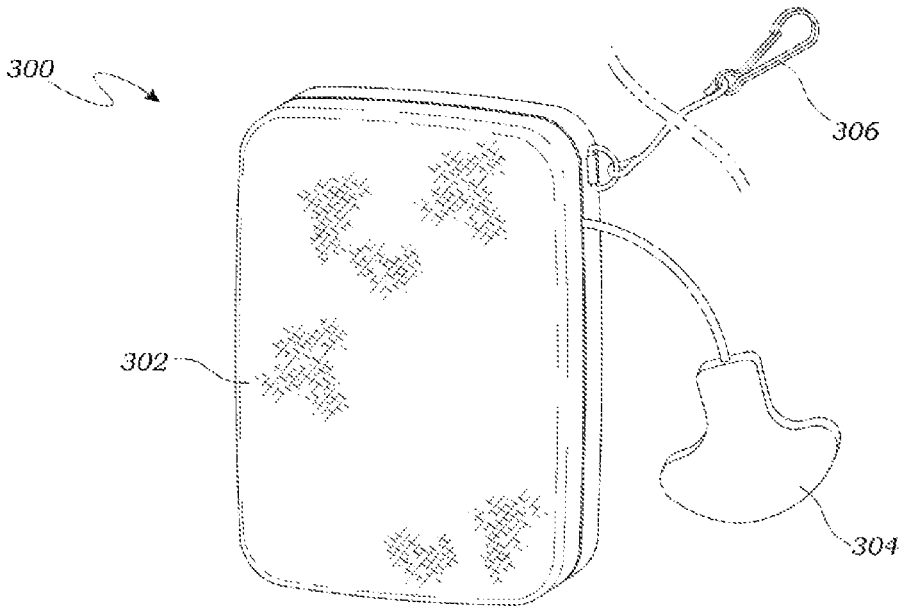
FIG. 22 is a perspective view of a flotation device in a compact carrier, the flotation device being shown in a collapsed state.

Any embodiments of the flotation devices disclosed herein (for example, the flotation device 300 illustrated in FIG. 22) can be configured such that, when the flotation device is in a deflated state, the flotation device can be stored in a small and compact enclosure or form 302. Some embodiments of the flotation device, when in a compact, pre-deployed state, can be pocket sized. The flotation device can optionally have a pull cord or other actuator 304 accessible from outside of the enclosure or form 302, and can optionally have a securing clip and/or a lanyard 306 which can be used to secure the device to a user. In some embodiments, the enclosure can be less than 3 pounds, or less than 5 pounds, or from approximately 3 pounds or less to approximately 7 pounds, or from approximately 3 pounds to approximately 5 pounds.

Additionally, some embodiments of the compact enclosure or form 302 of the flotation device can be less than approximately 100 cubic inches in total volume, or less than approximately 85 cubic inches in total volume, or less than approximately 72 cubic inches in total volume, or from approximately 70 cubic inches to approximately 100 cubic inches, such embodiments of the compact enclosure or form 302 of the flotation device being configured to float a 200 pound person above water. For example, and without limitation, some embodiments of the device can be approximately 1.5 in×4 in×5 in. Some embodiments of the flotation device may even be smaller in the compact state, for example when designed for smaller people. Larger embodiments may exceed the above-mentioned dimensions, but should use the same technology to be smaller and lighter than the legacy solutions. The material for one or more components of the flotation device embodiments disclosed herein can be thinner than 20 mils in thickness and with a tensile strength of at least 23 pounds per square inch. In larger embodiments of the flotation devices, the material can be thicker than 20 mils in thickness in order to provide a stronger, more puncture resistant air chamber.

Once inflation is initiated, embodiments of the inflation devices disclosed herein can be configured to quickly become buoyant, providing the distressed individual with assistance staying at the surface of the water without exerting energy and provides the individual the ability to fully exit the water so that the individual's body is not in direct contact with the water while waiting for assistance. Due to the inflatable floor in some embodiments, the flotation devices with an inflatable floor are able to put at least one inch of air between the water and the occupant, acting as a thermal insulator. This is beneficial to its function of extending the survival time of individuals waiting for rescue in cooler waters and is a major improvement over legacy life vests because full exposure to even mildly cold water can quickly cause hypothermia or death. Embodiments for use in warm water areas do not require the inclusion of an inflatable floor. The inflatable floor can be circumscribed, enclosed, and attached to the flotation element (also referred to as an air bladder) or plurality of flotation elements or air bladders forming a wall or gunwale. In some embodiments, the shape of the air bladder is elongated or slightly elliptical and designed to accommodate a single human user. However, any of the flotation element embodiments disclosed herein can have any desired shape, and can be defined by the enclosing air bladder's perimeter. The inflatable floor can be attached to the lower inner circumference of the air bladder or mid-way up the tube wall, creating a buoyant, thermally insulated cavity in which an individual can occupy.

The inflatable floor of any embodiments disclosed herein can include an ingress orifice to facilitate easy boarding, defined by a semi-detachable flap that can be affixed in the open or closed orientation by manipulating the flap. The ingress orifice allows an individual to enter the apparatus through the floor rather than climbing over the air bladder. This is beneficial, because climbing over an air bladder and into an apparatus requires significant strength and effort that an individual might not have if he or she is fatigued, injured, wearing bulky gear, such as a legacy life vest, or is simply not strong enough. Failing to enter the apparatus could prove fatal depending on the temperature of the water.

The semi-detachable flap can be configured to be easily opened, allowing for entry into the apparatus from underneath, and may be securely reattached, thereby resuming its function as a further portion of the structurally secured and thermally insulated floor. A wide variety of reversible securing mechanisms can be utilized to facilitate the semi-detachable flap's capability. Some embodiments can have a high strength plastic zipper. Other mechanisms can be used in the alternative or in addition to a zipper, including hook and loop systems, snaps, buttons, or other suitable fasteners.

The semi-detachable flap can be approximately 15 to 24 inches wide, allowing the user to easily board the raft by lifting himself out of the water, with one hand on each tube, once he or she has entered the orifice. The apparatus is designed so that an individual entering the apparatus through the ingress orifice can climb on the inflatable floor, which should be located just above the water level, thereby requiring minimal effort. This is an important feature, because a sufficiently wide ingress orifice allows an individual to position herself or himself square to the inflatable floor while boarding, thereby distributing his or her weight equally and reducing the possibility that the apparatus will tip or roll during boarding. In a preferred embodiment, the orifice can be between 20 to 36 inches in the opposing direction (length) so that an individual can climb through the ingress orifice created, by opening the semi-detachable flap with ease, especially when wearing other safety gear such as a legacy life vest.

To board the apparatus, an individual can either dive under the inflated apparatus and emerge with their body through the ingress orifice, or to enter the apparatus without putting their head below water, such as when the individual is wearing a life vest, the individual can lift the apparatus off the water by pressing upward on one end of the air bladder and lower the apparatus over his or her head. Some embodiments include an air bladder segment located adjacent the ingress orifice or is otherwise configured to be more flexible adjacent to the orifice, thereby increasing the ease with which the apparatus can be lifted, by increasing flexibility of the air bladder at the segment. In such embodiments, an individual can lift one end of the air bladder while the other end stays level with the water because of the added flexibility of the air bladder segment. An advantage of such a lightweight apparatus is that it may be easily lifted or manipulated in order to facilitate boarding.

Once an individual is positioned with his or her body through the ingress orifice, the individual can fully board the apparatus by pressing down on each side of the air bladder or simply crawling onto the inflated floor. Some embodiments include various loops, handles, or gripping points to assist boarding. After an individual is fully boarded, the semi-detachable flap may be closed and reattached, thereby preventing water from splashing into the apparatus and creating more floor space.

In another embodiment of the present disclosure, the air bladder does not continuously circumscribe the inflatable floor and there is no ingress orifice. Instead, the air bladder has a break, formed by distal ends of the air bladder that tightly abut one another and the inflatable floor features a semi-detachable slit. When the semi-detachable slit is in the attached orientation, the distal ends of the air bladder tightly abut each other, acting as a continuous gunwale. However, when the semi-detachable slit is in the open orientation, the distal ends of the air bladder can be horizontally separated by an individual, creating space to ingress the apparatus between the distal ends of the air bladder.

Once the individual is securely aboard, the semi-detachable slit in the inflatable floor can be returned to the attached orientation and the distal ends of the air bladder can be configured to orient and to securely abut each other, again creating a continuous gunwale. The semi-detachable slit utilizes a reversible attachment system. A preferred embodiment would feature a high strength plastic zipper, but other reversible fasteners will work as well, such as a sliding fastener, hook and loop systems, or buttons.

Figure 23:
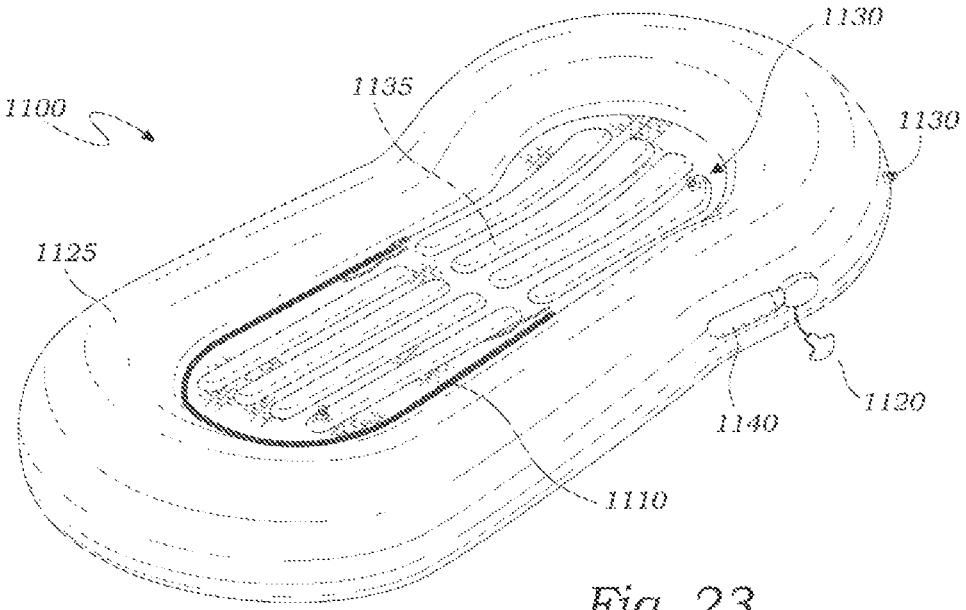
FIG. 23 is a perspective view of an embodiment of a flotation device, showing an embodiment of an ingress flap in a closed position.

FIG. 23 depicts the presently disclosed apparatus 1100 in a fully deployed orientation featuring a semi-detachable flap 1110 in the attached orientation covering the ingress orifice 1145. The apparatus can be automatically inflated when an individual pulls a pull cord 1120, just as with any embodiments disclosed herein. The illustrated embodiment shows a compressed gas cartridge 1140 as the source of the inflation gas. Other embodiments can use other sources of inflation gas.

FIG. 23 also shows a plurality of self-inflation valves 1130. These valves can be used to restore inflation if the apparatus slowly becomes deflated because of damage. In some embodiments, self-inflation may be the primary mode of inflation for the inflatable floor 1135, with automatic inflation only being available for the primary air bladder 1125.

Figure 24:
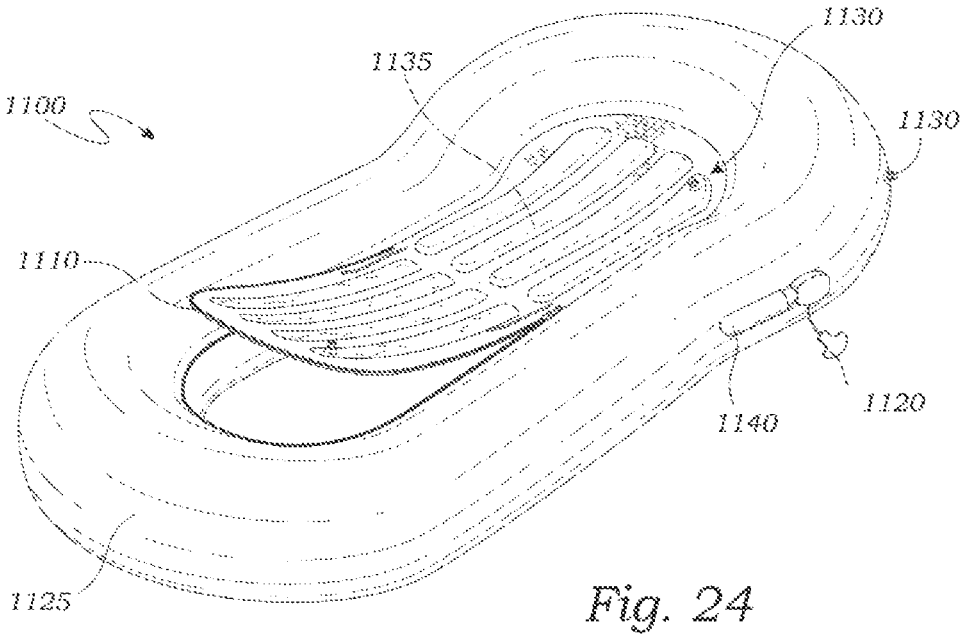
FIG. 24 is a perspective view of the embodiment of the flotation device shown in FIG. 23, showing the embodiment of the ingress flap in a partially open position to facilitate boarding of the device.

FIG. 24 shows the semi-detachable flap 1110 in the detached orientation thereby starting to expose the ingress orifice 1145. Once the semi-detachable flap 1110 is in the open orientation, an individual can board the apparatus through the ingress orifice 1145. In some embodiments, it is important that the ingress orifice 1145 is wide enough that the individual can board with his or her back square to the remaining portion of inflatable flooring 1135 because this is the most stable way to board the apparatus 1100.

Figure 25:
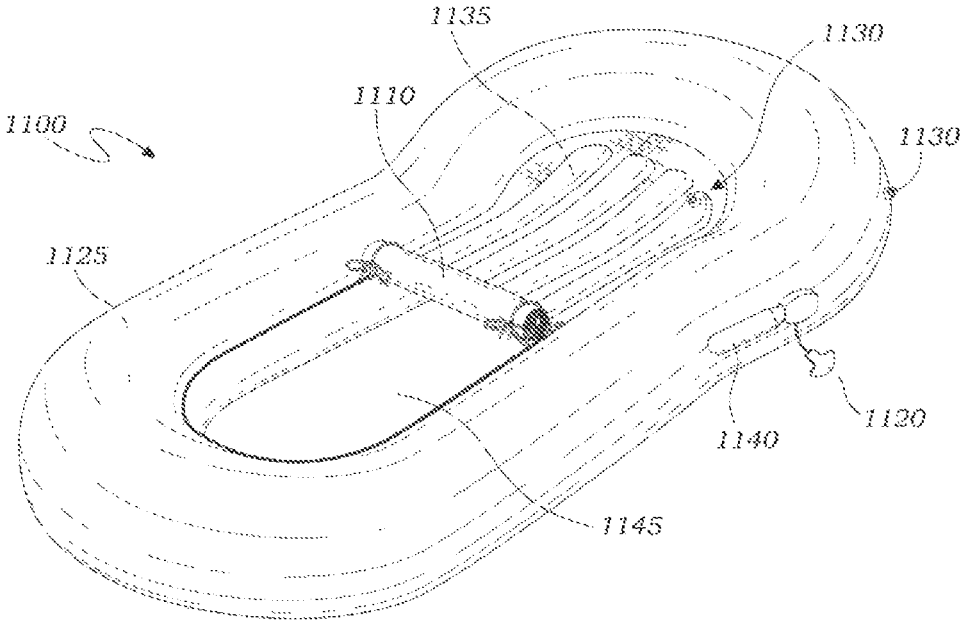
FIG. 25 is a perspective view of an embodiment of a flotation device, showing the embodiment of the ingress flap in an open, rolled up position to facilitate boarding of the device.

FIG. 25 shows the semi-detachable flap 1110 in the fully open, rolled, and tethered orientation. Some embodiments allow for the semi-detachable flap 1110 to be rolled and tethered so that it is fully out of the individual's way when boarding. In some embodiments, the semi-detachable flap 1110 may need to be manually inflated after the semi-detachable flap 1110 is unrolled and reattached.

Figure 26:
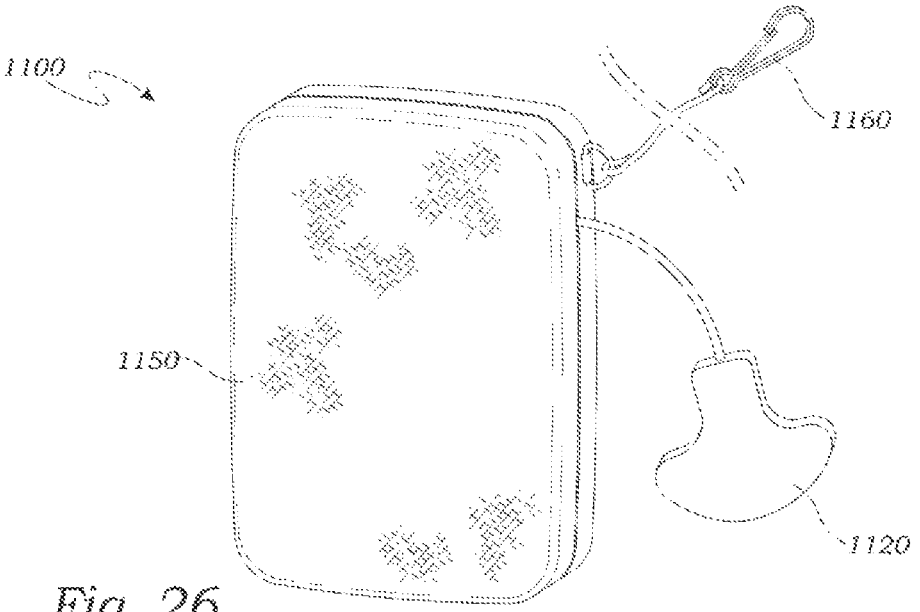
FIG. 26 is a perspective view of an embodiment of a flotation device, showing the device in a collapsed, pre-deployed state.

FIG. 26 illustrates an exemplary embodiment of the presently disclosed apparatus 1100 in the pre-deployed state. The illustrated embodiment illustrates a small, lightweight, case 1150 featuring only a pull cord 1120 to activate inflation and a tether 1160 to attach the apparatus 1100 to an individual performing routine low risk activities near water. In some embodiments, the tether 1160 can be attached to the apparatus 1100 rather than the case 1150 so that when an individual activates the inflation the apparatus 1100, the user can continue to grasp the tether 1160 to prevent the flotation device from drifting or blowing away.

Figure 27:
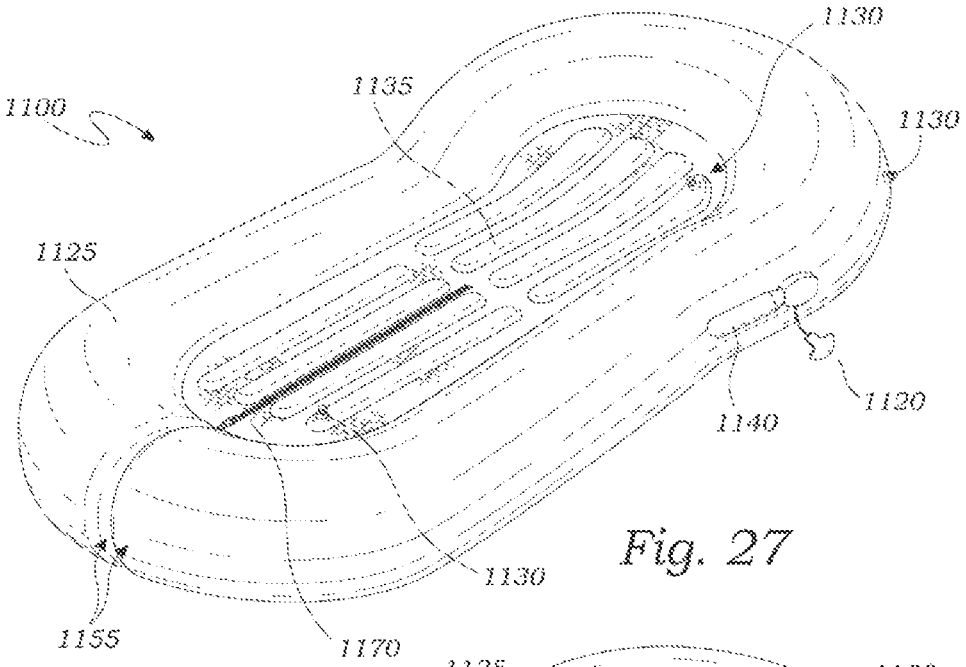
FIG. 27 is a perspective view of another embodiment of a flotation device, having a semi-detachable slit in the inflatable floor and a break at one end of the apparatus formed by two terminal ends of the air bladder.
Figure 28:
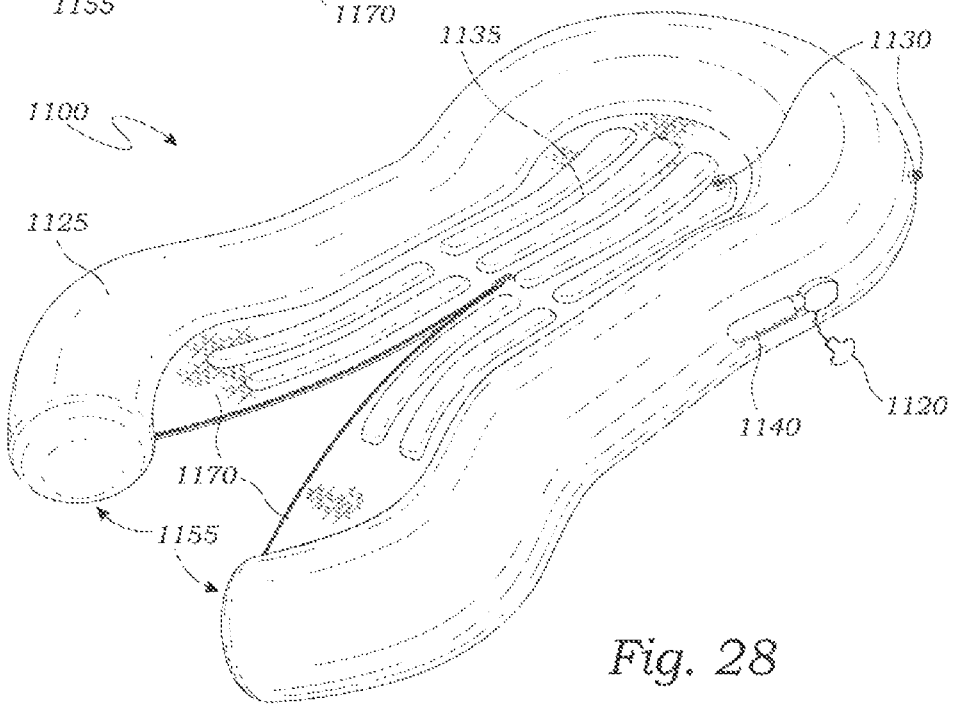
FIG. 28 is a perspective view of the embodiment of the flotation device shown in FIG. 27, showing the device in an open state to facilitate boarding of the device.

FIGS. 27 and 28 illustrate a different embodiment of the apparatus featuring a semi-detachable floor slit 1170 and split air bladder 1125 with two terminal ends 1155 that tightly abut each other, forming a continuous gunwale. When the semi-detachable floor slit 1170 is in the open orientation, the terminal ends 1155 can be separated, forming a space for easy ingress. FIG. 28 illustrates the embodiment in the ingress orientation.

Figure 29:
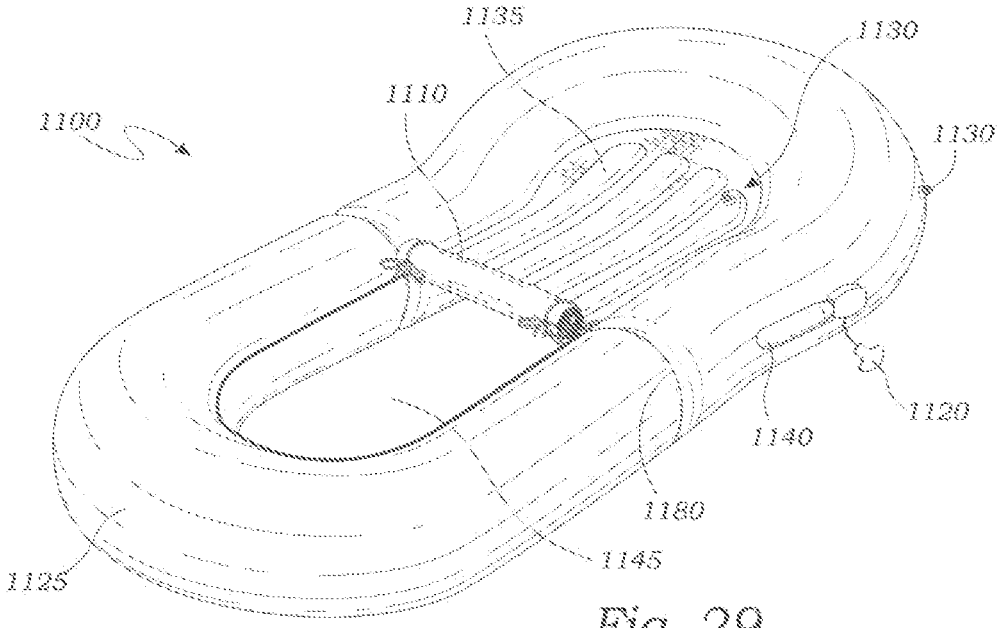
FIG. 29 is a perspective view of another embodiment of the flotation device, featuring the semi-detachable flap in the open, rolled, and tethered orientation to facilitate boarding.
Figure 30:
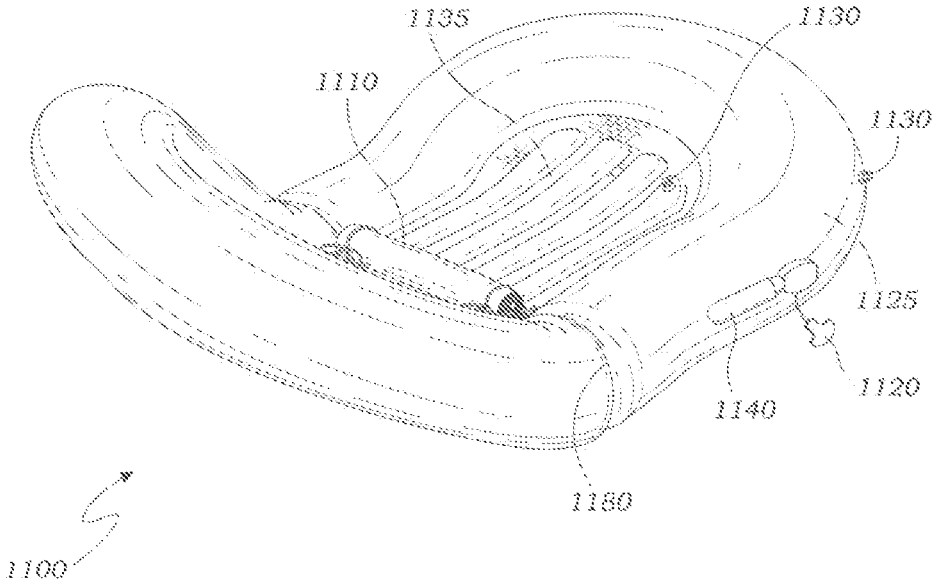
FIG. 30 is a perspective view of the embodiment of the flotation device shown in FIG. 29, showing a front portion of the device deflected to facilitate boarding of the device.

FIGS. 29 and 30 illustrate an additional air bladder segment 1180 to increase flexibility and allow for an individual to more easily reach the ingress orifice 1145. The air bladder segment 1180 adds flexibility so that an individual can lift half of the apparatus 1100 while the other half remains horizontal, supported by the water's surface as depicted in FIG. 30.

Figure 31:
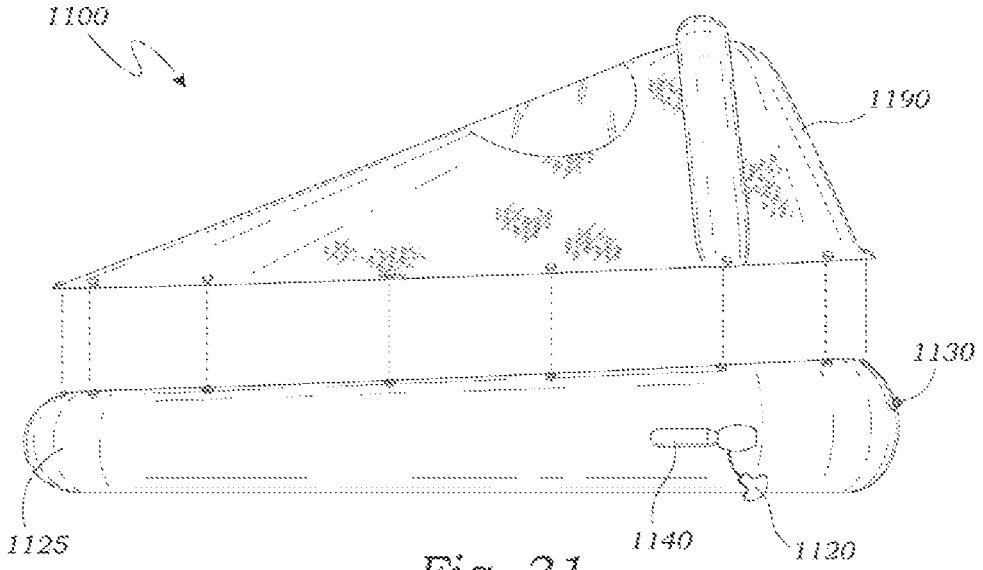
FIG. 31 is a side exploded view of an embodiment of a flotation device having an optional protective canopy.
Figure 32:
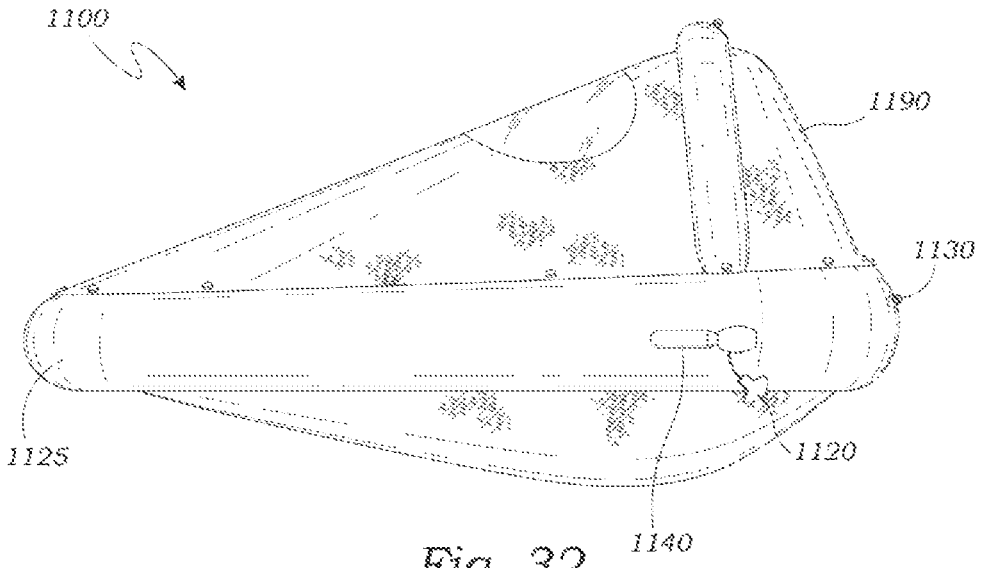
FIG. 32 is a side view of the embodiment of the flotation device shown in FIG. 31 in a fully deployed state.

FIGS. 31 and 32 feature an optional canopy 1190 to further protect an individual from the elements whether it be excessive sun, wind, or rain. The additional protection increases the thermal insulation of the individual and increases the chances of survival until assistance is able to arrive.

Figure 33:
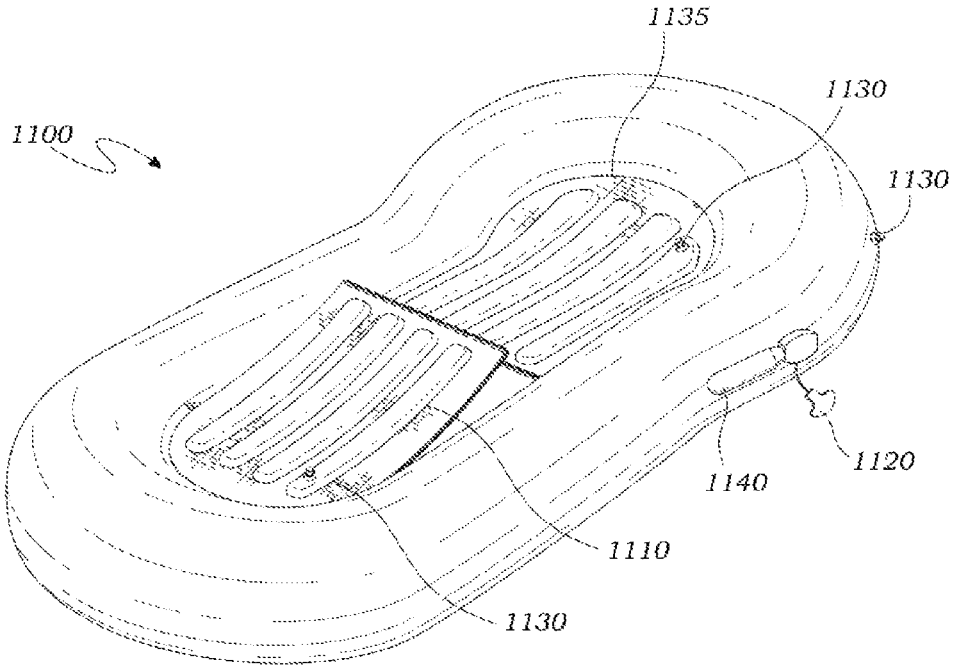
FIG. 33 is a perspective view of an embodiment of a flotation device having a semi-detachable flap covering an ingress orifice in a partially open position.
Figure 34:
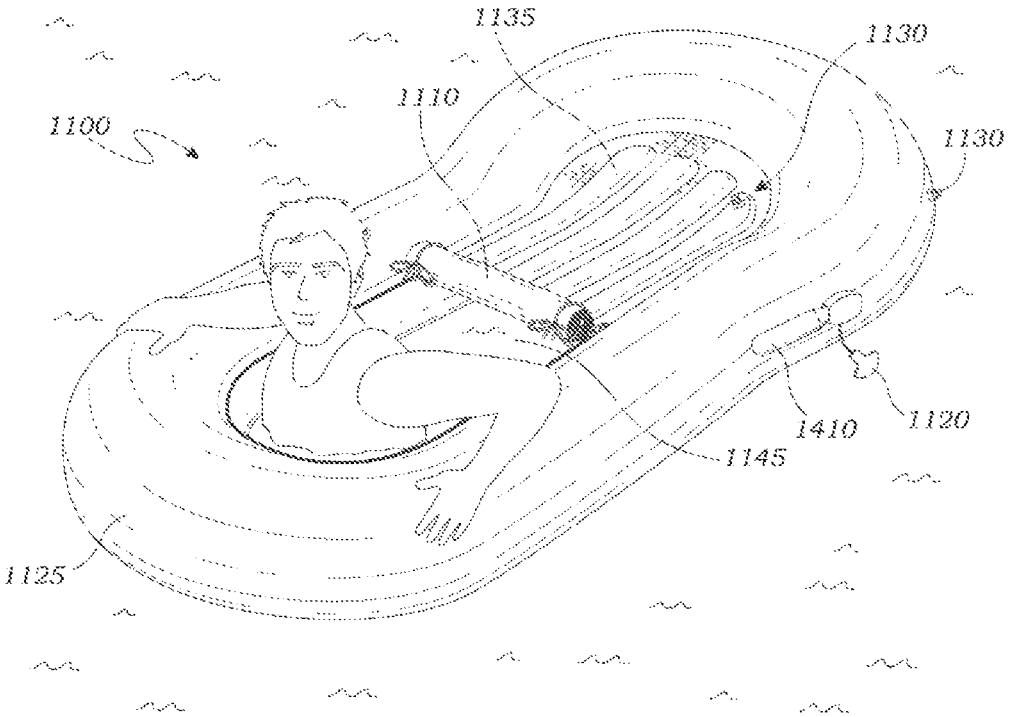
FIG. 34 is a perspective view of an embodiment of a flotation device, illustrating a person advancing through the opening in the floor portion of the flotation device.

FIG. 33 features an exemplary embodiment of the present disclosure 1100 featuring the semi-detachable flap 1110 in a different location than the illustration in FIG. 30. This illustration is included to emphasize that the semi-detachable flap and ingress orifice can be oriented differently in different embodiments. FIG. 34 illustrates an example individual boarding the apparatus 1100 through the ingress orifice 1145.

Any of the foregoing features or components can be used with any of the flotation device embodiments disclosed herein, in any desired combination with or in place of other features and components.

FIGS. 35 and 37 are a front view and a perspective view of an embodiment of an inflatable life preserver or inflatable life jacket 2000. FIG. 36 is a section view of a portion of the embodiment of the inflatable life preserver 2000 shown in FIG. 35, taken through line 36-36. With reference to FIGS. 35-37, the life preserver 2000 can have a main body portion 2002 that can be approximately horseshoe shaped, with a space in the middle for the user's neck. Any embodiments of the life preserver can have a conventional life preserver shape. The body portion 2002 can have an outer inflation chamber 2006 (also referred to herein as an active inflation chamber) and an inner inflation chamber 2008 (also referred to herein as a passive inflation chamber). In some embodiments, the body portion 2002, active inflation chamber 2006, and the passive inflation chamber 2008, and any other components of the life preserver 2000 can have any of the same components, features, materials, and/or other details of any of the embodiments of the flotation elements, active inflation chambers, passive inflation chambers, and flotation devices of any of the other embodiments of the flotation devices disclosed herein.

For example, and without limitation, the active inflation chamber 2006 can be inflated with a source of positive pressure 2014, for example and without limitation, by a compressed gas cartridge or cylinder through an actuator and valve component 2018, by actuating an actuator 2020, which can be a pull tab. Once the actuator and valve component 2018 are actuated, gas from the source of positive pressure can inflate the active inflation chamber 2006, thereby expanding the passive inflation chamber 2008 and causing the passive inflation chamber to draw air into the passive inflation chamber 2008 from the ambient air surrounding the life preserver through one or more valves (which can be one-way valves) or airways. The passive inflation chamber 2008 can be filled with ambient air until that chamber or chambers is/are at ambient pressure. Once the life preserver is in this substantially inflated state, the life preserve can be used as-is, or any of the chambers can be filled further using one or more oral inflation ports or valves, or via the original or an additional source of positive pressure, or any combination of the foregoing.

Figure 38:
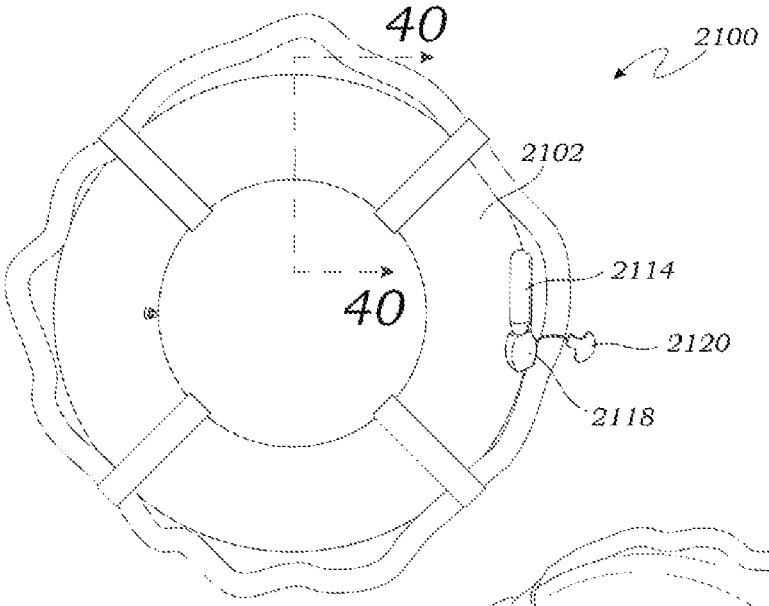
FIG. 38 is a front view of an embodiment of an inflatable life ring.
Figure 39:
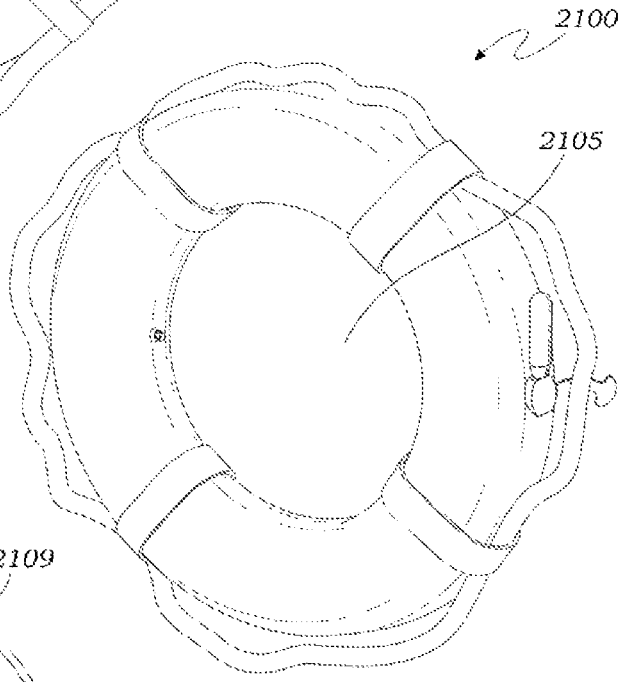
FIG. 39 is a perspective view of the embodiment of the inflatable life ring shown in FIG. 38.
Figure 40:
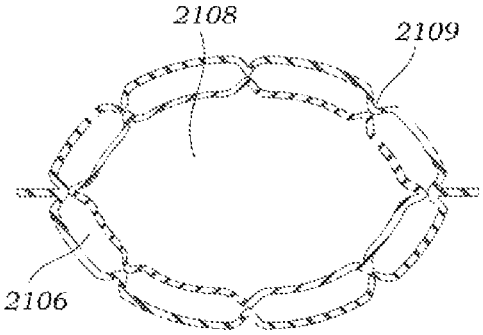
FIG. 40 is a section view of a portion of the embodiment of the inflatable life ring shown in FIG. 38, taken through line 40-40.

FIGS. 38 and 39 are a front view and a perspective view of an embodiment of an inflatable life ring 2100. FIG. 40 is a section view of a portion of the embodiment of the inflatable life ring 2100 shown in FIG. 38, taken through line 40-40. With reference to FIGS. 38-40, the life ring 2100 can have a main body portion 2102 that can have an approximately annular or ring shape, with a hole 2105 in the middle for receiving a person's body. Any embodiments of the life ring can have a conventional life ring shape. The body portion 2102 can have an outer inflation chamber 2106 (also referred to herein as an active inflation chamber) and an inner inflation chamber 2108 (also referred to herein as a passive inflation chamber). The active inflation chamber 2106 can have a plurality of interconnected air or gas chambers in fluid communication with one another. Welds, seals, or other joints 2109 can be used to join the layers of material together to form the plurality of chambers. In some embodiments, the body portion 2102, active inflation chamber 2106, and the passive inflation chamber 2108, and any other components of the life ring 2100 can have any of the same components, features, materials, and/or other details of any of the embodiments of the flotation elements, active inflation chambers, passive inflation chambers, and flotation devices of any of the other embodiments of the flotation devices disclosed herein.

For example and without limitation, the active inflation chamber 2106 can be inflated with a source of positive pressure 2114, for example and without limitation, by a compressed gas cartridge or cylinder through an actuator and valve component 2118, by actuating an actuator 2120, which can be a pull tab. Once the actuator and valve component 2118 are actuated, gas from the source of positive pressure can inflate the active inflation chamber 2106, thereby expanding the passive inflation chamber 2108 and causing the passive inflation chamber to draw air into the passive inflation chamber 2108 from the ambient air surrounding the life ring through one or more valves (which can be one-way valves) or airways. The passive inflation chamber 2108 can be filled with ambient air until that chamber or chambers is/are at ambient pressure. Once the life ring is in this substantially inflated state, the life preserve can be used as-is, or any of the chambers can be filled further using one or more oral inflation ports or valves, or via the original or an additional source of positive pressure, or any combination of the foregoing. Additionally, the life ring can have a strap or tether surrounding a perimeter of the life ring to permit the life ring to be more easily grasped by a user, and/or a longer tether for retrieving the life ring or drawing the life ring closer to the user.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A flotation device, comprising:

a multi-chamber flotation element, comprising:

an active inflation chamber; and a passive inflation chamber;

a first valve in fluid communication with the active inflation chamber; and an opening in fluid communication with the passive inflation chamber but not the active inflation chamber;

wherein:

the active inflation chamber is configured to be inflated through the first valve;

the active inflation chamber is configured to expand from a collapsed state to an expanded state as the active inflation chamber is inflated;

the active inflation chamber is configured to expand the passive inflation chamber from a collapsed state to an expanded state as the active inflation chamber is expanded; and the opening in the passive inflation chamber is configured to permit ambient air to enter the passive inflation chamber when a pressure within the passive inflation chamber is less than an ambient air pressure surrounding the flotation device so that the passive inflation chamber can be filled with air as the passive inflation chamber expands.

2. The flotation device of claim 1, wherein the opening in the passive inflation chamber is configured to at least inhibit air from exiting the passive inflation chamber through the opening.

3. The flotation device of claim 1, wherein a volume of the passive inflation chamber is at least as large as a volume of the active inflation chamber when the multi-chamber flotation element is in a substantially expanded state.

4. The flotation device of claim 1, further comprising an automatic inflation mechanism configured to expand the active inflation chamber upon activation of the automatic inflation mechanism.

5. The flotation device of claim 1, further comprising a pressurized gas cartridge configured to expand the active inflation chamber upon activation of the pressurized gas cartridge.

6. The flotation device of claim 1, further comprising a pump configured to expand the active inflation chamber upon activation of the pump.

7. The flotation device of claim 1, further comprising an oral inflation mechanism in fluid communication with at least one of the active inflation chamber and the passive inflation chamber.

8. The flotation device of claim 1, wherein the multi-chamber flotation element is configured to receive air from a source of positive pressure so that additional air can be added to at least one of the active inflation chamber and the passive inflation chamber.

9. The flotation device of claim 1, further comprising a valve in fluid communication with the passive inflation chamber and configured to permit air to be added to the passive inflation chamber from a source of positive pressure.

10. The flotation device of claim 1, comprising a floor portion surrounded by the multi-chamber flotation element.

11. The flotation device of claim 10, further comprising an opening in the floor portion that is selectively coverable with a flap, wherein:

the flap is deflectable, rollable, or otherwise movable from a first position in which the opening is covered by the flap to a second position in which the flap does not cover all or a portion of the opening;

when the flap is in the second position, a user can enter the inflatable device through the opening in the floor portion;

the flap has a selectively reversible securing mechanism on a portion of the flap or coupled with the flap so that the flap is selectively securable in the first position.

12. The flotation device of claim 1, wherein the flotation element is constructed from a material having a thickness of no greater than 20 mils and a tensile strength of at least 23 lbs. per square inch.

13. The flotation device of claim 1, wherein the active inflation chamber comprises an inner wall and an outer wall, wherein the inner wall is completely surrounded by the outer wall.

14. The flotation device of claim 13, wherein the inner wall is coupled with the outer wall with at least one of one or more baffles, one or more welds, one or more threads, and one or more gussets.

15. The flotation device of claim 1, comprising a second valve in fluid communication with the active inflation chamber and the passive inflation chamber, wherein the second valve is configured to open and permit gas from the active inflation chamber to pass into the passive inflation chamber when a pressure level within the active inflation chamber exceeds a threshold level, thereby increasing a pressure level within the passive inflation chamber.

16. An inflatable device, comprising:

a floor portion;

a first chamber coupled with the floor portion and expandable from a deflated state to at least an expanded state, wherein the first chamber surrounds a perimeter of the floor portion;

a second chamber coupled with the first chamber;

a valve in fluid communication with the first chamber;

wherein:

the first chamber is isolated from the second chamber such that the first chamber is not in fluid communication with the second chamber; and the second chamber is configured to be automatically expanded from a first collapsed state to a second expanded state when the first chamber is expanded from a first collapsed state to a second expanded state.

17. The inflatable device of claim 16, further comprising a compressed gas cartridge in fluid communication with the first chamber.

18. The inflatable device of claim 16, further comprising a one-way valve in fluid communication with the second chamber, the valve configured to permit ambient air to enter the second chamber as the first chamber is being expanded from the deflated state to the expanded state.

19. An inflatable device, comprising:

a multi-chamber inflation element comprising:

an active inflation chamber having at least an inner wall and an outer wall; and a passive inflation chamber;

a first valve in fluid communication with the active inflation chamber;

a selectively openable or automatically openable port in fluid communication with the passive inflation chamber;

wherein:

the active inflation chamber surrounds at least a portion of the passive inflation chamber;

the active inflation chamber is configured to be inflated through the first valve;

the active inflation chamber is configured to expand from a collapsed state to an expanded state as the active inflation chamber is inflated; and the active inflation chamber is configured to expand the passive inflation chamber from a collapsed state to an expanded state as the active inflation chamber is expanded.

20. The flotation device of claim 1, wherein the flotation device is configured use less than approximately 45% of a volume of a gas that would be used to inflate a single chamber flotation device having a level of buoyancy that is the same as that of the flotation device.

21. The flotation device of claim 1, wherein the flotation device is configured to use less than approximately 2 cubic feet of air or equivalent compressed gas to sufficiently float a person of approximately 275 pounds completely out of the water.

22. The flotation device of claim 1, wherein the volume of the passive inflation chamber is at least 55% of the total volume of the multi-chamber flotation element when the multi-chamber flotation element is in a substantially expanded state.

23. The flotation device of claim 1, wherein at least 40% of a total volume of the multi-chamber flotation element can be inflated from air automatically drawn in from the atmosphere into the passive inflation chamber during inflation of the inflation element.

24. The flotation device of claim 1, wherein the flotation device is configured to support at least a 150 pound person completely out of the water when the multi-chamber flotation element is in an expanded state.

25. The flotation device of claim 1, wherein at least 70% of the surface area of the passive inflation chamber is surrounded or covered by the active inflation chamber.

26. The flotation device of claim 1, wherein the active inflation chamber is outside of the passive inflation chamber and less than 70% of the surface area of the passive inflation chamber is surrounded or covered by the active inflation chamber.

27. The flotation device of claim 1, wherein the entire surface area of the passive inflation chamber is surrounded or covered by the active inflation chamber.

28. The flotation device of claim 1, further comprising an expanding foam cartridge configured to expand the active inflation chamber upon activation of the expanding foam cartridge.

29. The inflatable device of claim 16, comprising an opening in fluid communication with the second chamber, wherein the opening is configured to permit ambient air to enter the second chamber when a pressure within the second chamber is less than an ambient air pressure surrounding the second chamber so that the second chamber can be filled with ambient air as the second chamber is expanded.

30. The inflatable device of claim 27, further comprising a valve in fluid communication with the opening configured to prevent air from exiting the second chamber through the opening.

31. The inflatable device of claim 16, wherein the inflatable device is configured to support at least a 150 pound person completely out of the water when inflatable device is in an expanded state.

32. The inflatable device of claim 16, wherein a volume of the second chamber is at least as large as a volume of the first chamber when the second chamber and the first chamber are both in a substantially expanded state.

33. The inflatable device of claim 16, further comprising a source of positive pressure in communication with the first chamber and configured to expand the first chamber from the deflated state to at least a partially expanded state upon activation of the source of positive pressure.

34. The inflatable device of claim 16, wherein at least 70% of the surface area of the second chamber is surrounded or covered by the first chamber.

35. The inflatable device of claim 19, wherein the active inflation chamber surrounds and encloses at least a substantial portion of the passive inflation chamber.

36. The inflatable device of claim 19, wherein the inner wall encloses the passive inflation chamber.

37. The inflatable device of claim 19, wherein the multi-chamber inflation element is configured such that at least 40% of the volume of the multi-chamber inflation element is filled with ambient air drawn into the multi-chamber inflation element as the multi-chamber inflation element is being expanded from the collapsed state to the expanded state.

38. The inflatable device of claim 19, further comprising a source of positive pressure configured to expand the active inflation chamber from the collapsed state to at least a partially expanded state upon activation of the source of positive pressure.

* * * * *